US005114130A

United States Patent [19]

Hamanaka et al.

[11] Patent Number: 5,114,130

[45] Date of Patent: * May 19, 1992

[54] RECORDED SHEET HANDLING APPARATUS

[75] Inventors: Izumi Hamanaka; Yoshikazu Maekawa; Hiroyuki Arai; Akihiko Nishiki, all of Hachioji; Takeshi Muramatsu, Sayama; Toshio Yokoyama, Kiyose; Shigemi Yukizane, Chofu, all of Japan

[73] Assignee: Konica Corporation, Japan

[ * ] Notice: The portion of the term of this patent subsequent to Feb. 6, 2007 has been disclaimed.

[21] Appl. No.: 584,498

[22] Filed: Sep. 17, 1990

Related U.S. Application Data

[63] Continuation of Ser. No. 445,110, Dec. 1, 1989, abandoned, which is a continuation of Ser. No. 146,569, Jan. 21, 1988, abandoned.

[30] Foreign Application Priority Data

| | | | |
|---|---|---|---|
| Jan. 23, 1987 | [JP] | Japan | 62-12201 |
| Jul. 14, 1987 | [JP] | Japan | 62-173951 |
| Jul. 14, 1987 | [JP] | Japan | 62-173952 |
| Jul. 24, 1987 | [JP] | Japan | 62-183431 |
| Aug. 18, 1987 | [JP] | Japan | 62-203572 |
| Sep. 14, 1987 | [JP] | Japan | 62-228624 |
| Nov. 20, 1987 | [JP] | Japan | 62-291712 |

[51] Int. Cl.[5] ..... B42B 2/00

[52] U.S. Cl. ..... 270/53; 270/58; 83/622

[58] Field of Search ..... 270/37, 53, 58; 355/308, 313, 317, 321, 324; 227/27; 83/622, 629, 630

[56] References Cited

U.S. PATENT DOCUMENTS

| | | | |
|---|---|---|---|
| 3,227,023 | 1/1966 | Bouvier | 83/622 |
| 4,083,550 | 4/1978 | Pal | 270/53 |
| 4,248,525 | 2/1981 | Stenett | 270/58 |
| 4,424,963 | 1/1984 | Bartholet et al. | 270/53 |
| 4,497,478 | 2/1985 | Reschenhofer | 270/53 |
| 4,516,714 | 5/1985 | Braun | 227/111 |
| 4,575,296 | 3/1986 | Kockler et al. | 270/53 |
| 4,586,640 | 5/1986 | Smith | 270/53 |
| 4,763,167 | 8/1988 | Watanabe et al. | 355/35 H |
| 4,898,372 | 2/1990 | Hirabayashi | 270/53 |

FOREIGN PATENT DOCUMENTS

| | | | |
|---|---|---|---|
| 99250 | 1/1984 | European Pat. Off. | 270/53 |
| 72569 | 4/1986 | Japan | 270/53 |
| 524688 | 2/1977 | U.S.S.R. | 83/622 |
| 1373 | of 1855 | United Kingdom | 83/622 |

*Primary Examiner*—Edward K. Look
*Assistant Examiner*—Therese M. Newholm
*Attorney, Agent, or Firm*—Jordan B. Bierman

[57] ABSTRACT

A recorded sheet handling apparatus includes an intermediate holding section as a stacker for holding a set of recorded sheets externally fed one by one and stacked in a feeding order, a handling unit for selectively punching and/or stapling the set of recorded sheets held in the intermediate holding section at a holding position, a storage tray for storing the handled recorded sheets, first convey rollers for conveying the recorded sheets prior to handling to the intermediate holding section, and second convey rollers for conveying the handled recorded sheets to the storage tray.

26 Claims, 12 Drawing Sheets

RECORDED SHEET HANDLING APPARATUS

This application is a continuation of application Ser. No. 445,110, filed Dec. 1, 1989, now abandoned. This application is a continuation of application Ser. No. 146,569, filed Jan. 21, 1988, now abandoned.

BACKGROUND OF THE INVENTION

1. Field of the Invention

The present invention relates to a recorded sheet handling apparatus suitably used together with a recording apparatus such as a copying machine.

2. Description of the Prior Art

In recent years, conventional recording apparatuses such as printers and facsimile systems in addition to copying machines have been used in various fields. In these recording apparatuses, multi-functional, high-speed features are required for the copying machines.

When conference data and distribution data are to be prepared in the form of a recorded document by a recording apparatus such as a copying machine, the recorded sheets must be aligned, folded, punched, or stapled. Many attempts have been made to automate these operations so as to improve total copying efficiency. For this purpose, a sorter for sorting the copied sheets, an automatic punching apparatus, an automatic folding machine, an automatic gathering machine, and a handling apparatus as a combination of these apparatuses and machines have been proposed, as described in Japanese Unexamined Patent Publication (Kokai) Nos. 61-94180 and 61-84662 and a publication from the Institute of Electrophotography of Japan, Vol. 24, No. 3, 1985, PP. 188–194.

The recorded sheets are often stapled or filed for later use. However, a handling apparatus for punching and stapling the recorded sheets has never been proposed.

SUMMARY OF THE INVENTION

It is an object of the present invention to provide a recorded sheet handling apparatus capable of automatically punching and/or stapling recorded sheets to prepare sets of documents.

It is another object of the present invention to provide a recorded sheet handling apparatus capable of variably changing a punching and/or stapling position from the side edge of the recorded sheet.

It is still another object of the present invention to provide a recorded sheet handling apparatus capable of variably changing a punching and/or stapling position from the leading edge of the recorded sheet.

It is still another object of the present invention to provide a recorded sheet handling apparatus capable of shortening time required for moving a stapler when the size of recorded sheets is changed.

It is still another object of the present invention to provide a recorded sheet handling apparatus wherein recorded sheets subjected to stapling can be properly located at the stapling position.

It is still another object of the present invention to provide a recorded sheet handling apparatus capable of smoothly conveying handled sheets to a storage section.

It is still another object of the present invention to provide a recorded sheet handling apparatus which can be used even if punching or stapling is not performed or the punching and stapling mechanisms are out of order.

It is still another object of the present invention to provide a recorded sheet handling apparatus having a simple arrangement so as to hold a set of recorded sheets and convey the punched or stapled sheets to the storage section.

It is still another object of the present invention to provide a recorded sheet handling apparatus for preventing misalignment of sheets during conveyance of a plurality of sheets.

It is still another object of the present invention to provide a recorded sheet handling apparatus capable of easily replenishing the stapler with staples and removing punching dust.

It is still another object of the present invention to provide a recorded sheet handling apparatus capable of punching or stapling sheets regardless of a scheme for feeding a document to be recorded.

It is still another object of the present invention to provide a recorded sheet handling apparatus which prevents double handling of at least two identical recorded sheets obtained from one original constituting the document.

It is still another object of the present invention to provide a recorded sheet handing apparatus wherein a recorded sheet during handling can be easily removed even if a motor as a driving source for punching is stopped during punching.

It is still another object of the present invention to provide a recorded sheet handling apparatus capable of properly punching recorded sheets.

It is still another object of the present invention to provide a recorded sheet handling apparatus having a simple structure for eliminating torsion caused by a pressure during punching.

It is still another object of the present invention to provide a recorded sheet handling apparatus with a punching machine driving motor having a small capacity.

It is still another object of the present invention to provide a recorded sheet handling apparatus which has a simple unit for transmitting a punching force to a punching pin in a punching machine and which can simplify punching pin replacement.

It is still another object of the present invention to provide a recorded sheet handling apparatus which can simplify removal of punching dust.

The above objects are achieved such that a set of recorded sheets externally fed one by one are sequentially stacked in the feeding order, the sides of each recorded sheet are clamped and moved to achieve sheet alignment, and the set of sheets are selectively punched or stapled at a holding position.

DETAILED DESCRIPTION OF THE PREFERRED EMBODIMENTS

The present invention will be described in detail with reference to the accompanying drawings.

An illustrated handling apparatus is a copied sheet handling apparatus used together with a copying machine. As shown in the schematic view of FIG. 1, a copied sheet handling apparatus 1 is coupled to a copying machine 2 at a position indicated by a broken line E.

Prior to a description of the copied sheet handling apparatus 1 as the characteristic feature of the present invention, the copying machine 2 will be briefly described.

Since the copied sheet handling apparatus which can employ the present invention must punch or staple a set of copied sheets obtained from a plurality of originals constituting the document (e.g., five pages from page 1 to page 5 of a book), the copying machine must have a function for sequentially, repeatedly copying the plurality of originals. In this sense, the copying machine must have a recirculation type automatic document feeder (to be referred to as an RDF hereinafter).

Figure 1:
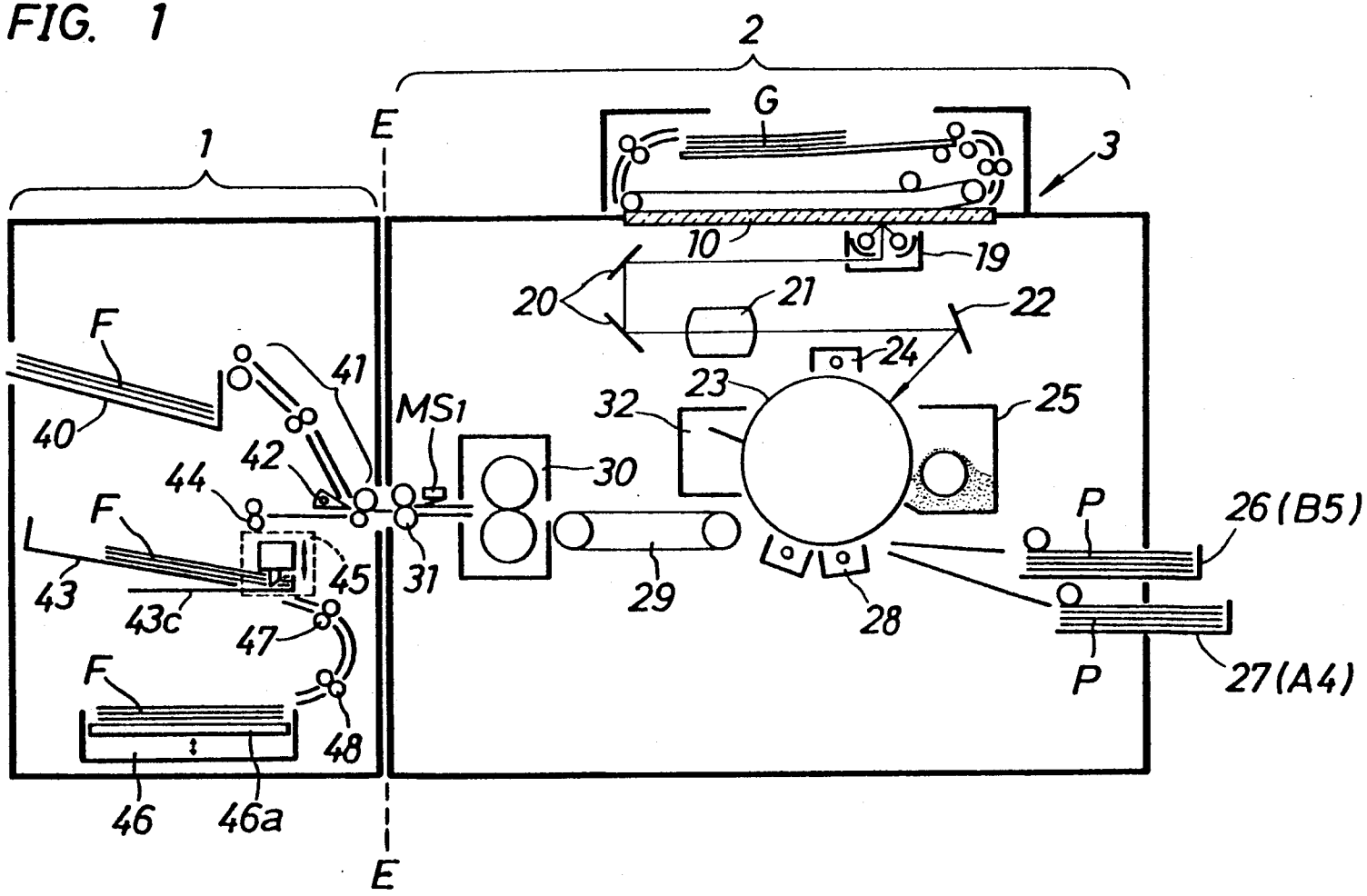
FIG. 1 is a schematic view of a copied sheet handling apparatus as a recorded sheet handling apparatus shown together with a copying machine.

As is apparent from FIG. 1, an RDF 3 is attached to the upper portion of the copying machine 2. Document originals fed one by one by the RDF 3 are copied by the conventional electrophotographic processes. The structures and functions of the copying machine 2 and the RDF 3 are known to those skilled in the art and will be briefly described.

Figure 2:
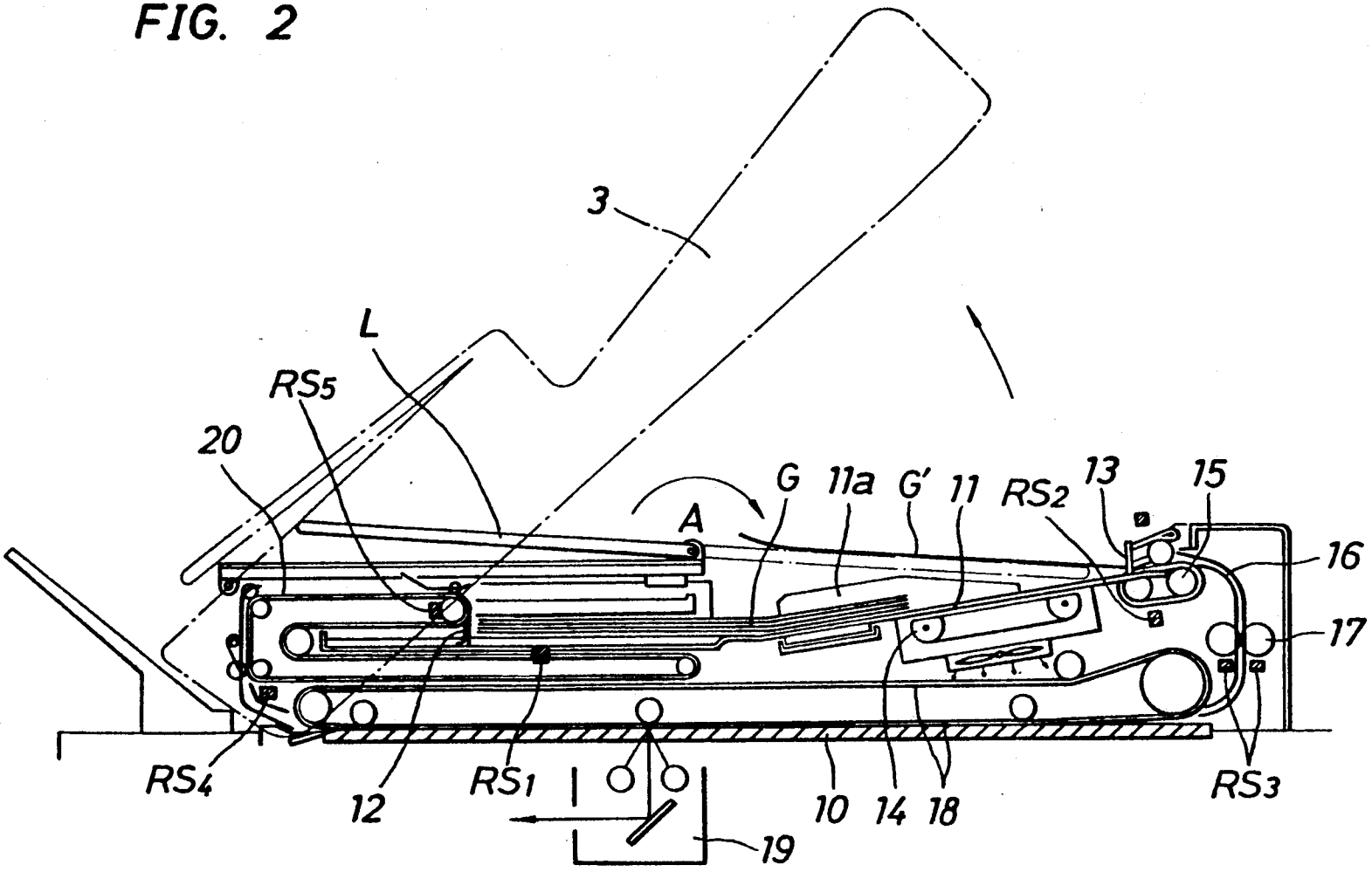
FIG. 2 is a schematic view of a recirculation type automatic document feeder (RDF) constituting part of the copying machine.

The RDF 3 is mounted on a glass plate 10 arranged on the upper surface of the copying machine 2. As shown in FIG. 2, a plurality of originals G to be copied are placed on a document table 11 while the originals G face upward. In this case, the first page, the second page, . . . . are stacked from the top. A document regulating plate 11*a* slidable along the widthwise direction of the original is arranged on the document table 11. When the originals are placed and the regulating plate 11*a* is slid to the sides of the originals, a microswitch (indicated by $MS_2$ in FIG. 11) located at a position corresponding to the size of the placed originals is turned on to output a document size signal. A document sensor $RS_1$ detects that the originals of the document are placed on the document table 11. When an operator depresses a copy button arranged in the operation panel of the copying machine 2, a trailing end regulating plate 12 of the RDF 3 is moved forward, and the document constituted by the originals G is entirely moved forward (the right direction in FIG. 1). At the same time, a gate 13 located on the document feed path is moved upward. The originals G pass through the gate 13 and are slightly fed to a predetermined position. When a document distal end detection sensor $RS_2$ detects the originals G, the trailing end regulating plate 12 is stopped and the gate 13 is moved downward. The trailing end regulating plate 12 is then moved backward.

When a document feed signal is output from the copying machine 2 at a predetermined timing, semi-circular feed rollers 14 are rotated by one revolution and at the same time double feed preventive rollers 15 are rotated to feed only the lowermost original of the document. The fed original is fed by document feed rollers 17 along a guide plate 16. The leading end of the original is detected by a timing sensor $RS_3$ and is transferred to a conveyor belt 18. The original travels on the glass plate 10 of the copying machine 2 at a predetermined speed. An optical system 19 including a document illumination lamp and a reflecting mirror is arranged below the glass plate 10. The original is exposed by the optical system 19 while the original is being conveyed. When the leading end detection signal is sent from the timing sensor $RS_3$ to the copying machine 2, a transfer sheet is fed in the copying machine 2. The original exposed with light is detected by a discharge sensor $RS_4$ and is conveyed by another conveyor belt 20. The discharged original is stacked on the remaining originals on the document table 11. Discharge of the last original is detected by a recirculation paper sensor $RS_5$ Jamming during original feeding is detected by detection timing signals from the sensors $RS_3$ and $RS_4$.

Feeding of the second original of the document is started when the trailing end of the first original is detected by the timing sensor $RS_3$.

When the third original, the fourth original, . . . and the last original are exposed with light emitted from the optical system in the copying machine, the leading end detection sensor $RS_2$ detects that no originals of the document are left, thereby completing feeding of all originals of each document.

If five sets of copies are to be prepared from one document consisting of a plurality of originals, the originals are fed from the last page to the first page by the RDF. The document feed cycle is repeated by the number corresponding to the desired sets of copies.

The recording apparatus according to the present invention is used together with the RDF and can punch or staple of the recorded sheets obtained from a book or a document consisting of the plurality of originals having different sizes (to be described later). For these purposes, the RDF 3 can be pivoted about the left end (FIG. 2) to the position indicated by the alternate long and short dashed line in FIG. 2. A manual guide plate L is mounted at the uppermost portion of the RDF 3 and can be pivoted about point A from one substantially horizontal position (the position indicated by the solid line) and the other horizontal position (the position indicated by the alternate long and short dashed line) which is 180° out of phase from one horizontal position.

In synchronism with the above operations of the RDF 3, the following electrophotographic operations are performed in the copying machine 2.

When an original of the document passing along the glass plate 10 of the copying machine 2 at a constant speed is exposed with the optical system 19, light reflected by the original is incident on a photosensitive body 23 through a mirror 20, a lens 21, and a mirror 22. Since the surface of the photosensitive body 23 is uniformly charged by a charging unit 24, incidence of the light reflected by the original allows formation of a latent image. The latent image is developed by a developing unit 25 and a visual or toner image is obtained. The visual image is transferred by a transfer unit 28 to the transfer sheet P fed from one of paper cassettes 26 and 27.

The transfer sheet having the visual image thereon is separated from the photosensitive body 23 by a separating unit and is conveyed by a conveyor belt 29. The conveyed sheet is then fixed by a fixing unit 30. The sheet is then discharged from the copying machine by a discharge roller 31. Reference numeral 32 denotes a cleaning unit for removing residual toner particles from the surface of the photosensitive body 23 after the transfer sheet is separated from the photosensitive body.

The copying machine is exemplified by the most simple one for performing one-sided copying using a one-sided original. However, the recorded sheet handling apparatus according to the present invention may be combined with a copying machine for performing both-sided copying using a one-sided original or one- or both-sided copying using a both-sided original. In order to perform the above copying operations, each original must be reversed or each transfer sheet must be reversed. The copying machine 2 and the RDF 3 must have transfer sheet and document original reversing mechanisms, respectively. These mechanisms are known to those skilled in the art, and a detailed description thereof will be omitted since these mechanisms are out of scope of the present invention.

As shown in FIG. 1, the copied sheet handling apparatus 1 according to the present invention comprises: convey rollers 41 for delivering sheets F copied and discharged from the copying machine 2 to a discharge tray 40 without punching or stapling the copied sheets F; convey rollers 44 for conveying the copied sheets F to an intermediate tray 43 called a stacker so as to punch or staple the copied sheets F after a path switching gate 42 is switched; a handling unit 45 for punching or stapling the copied sheets F serving as one set of document stacked on the stacker 43; and convey rollers 47 and 48 for finally conveying punched or stapled sheets F to a storage tray 46. Of the above members, the convey rollers 41, the intermediate tray 43, the convey rollers 44, the handling unit 45, the storage tray 46, and the convey rollers 47 and 48 are independent units in favor of assembly and maintenance. These units can be independently attached to or detached from the apparatus 1. For example, the handling unit 45 comprises a punching machine and two staplers arranged at two sides of the punching machine. As indicated by arrow A in FIG. 3, the handling unit 45 can be pulled toward the operator (i.e., an upward direction perpendicular to the drawing surface of FIG. 1) due to the following reasons. The punching dust as a result of punching must be easily removed, the staplers must be easily replenished with staples, and the clogging staples must be easily removed.

Figure 10:
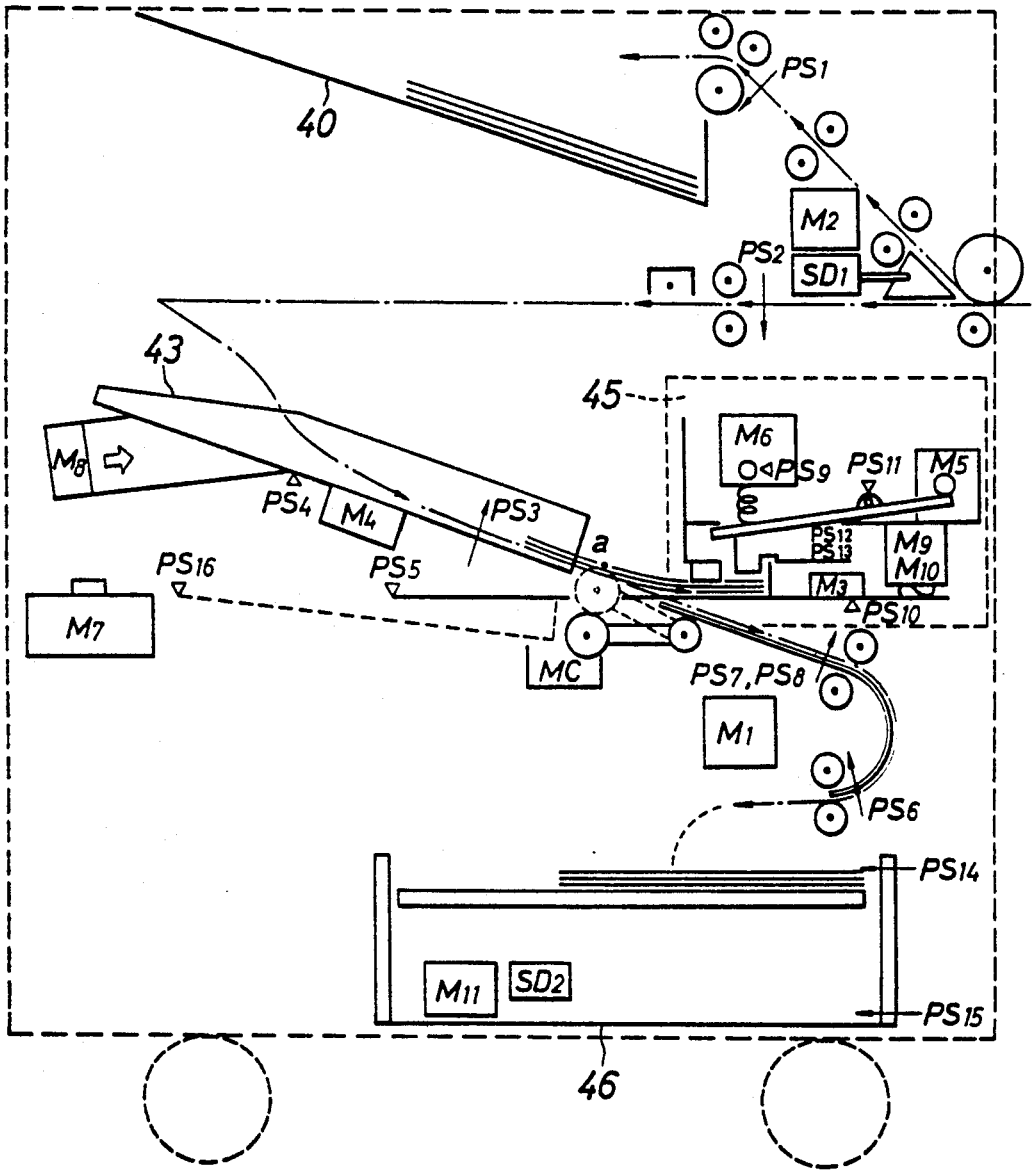
FIG. 10 is a view showing the layout of motors, sensors, and solenoids in the copying sheet recording apparatus.

The storage tray 46 is arranged such that its base 46*a* for supporting the handled sheets F can be vertically moved. The base 46*a* can be vertically moved by a tray lifting motor $M_{11}$ (FIG. 10). When the height of the sheets F on the base 46*a* exceeds a predetermined value, it is detected by a tray upper limit sensor $PS_{14}$. The lower limit of the position of the tray 46 is detected by a tray lower limit sensor $PS_{15}$. When the tray upper limit sensor $PS_{14}$ detects that the position of the tray 46*a* exceeds the upper limit position, upward movement of the base 46*a* by the tray lifting motor $M_{11}$ is stopped. However, when the tray lower limit sensor $PS_{15}$ detects that the tray position is lower than the lower limit position, downward movement of the base 46*a* by the tray lifting motor $M_{11}$ is stopped. In addition, a solenoid $SD_2$ is operated to brake the base 46*a* so as not to further move the base 46*a* downward due to the weight of the handled sheets F on the base 46*a*.

The convey rollers 47 or 48 comprise roller pairs each for guiding the both sides of the sheets F and conveying them at a constant speed so as to prevent misalignment of the sheets F. At least one roller of the roller pair is covered with a flexible material such as a sponge material.

The structure of the copied sheet handling apparatus employing the handling unit described above will be described in detail below.

Figure 3:
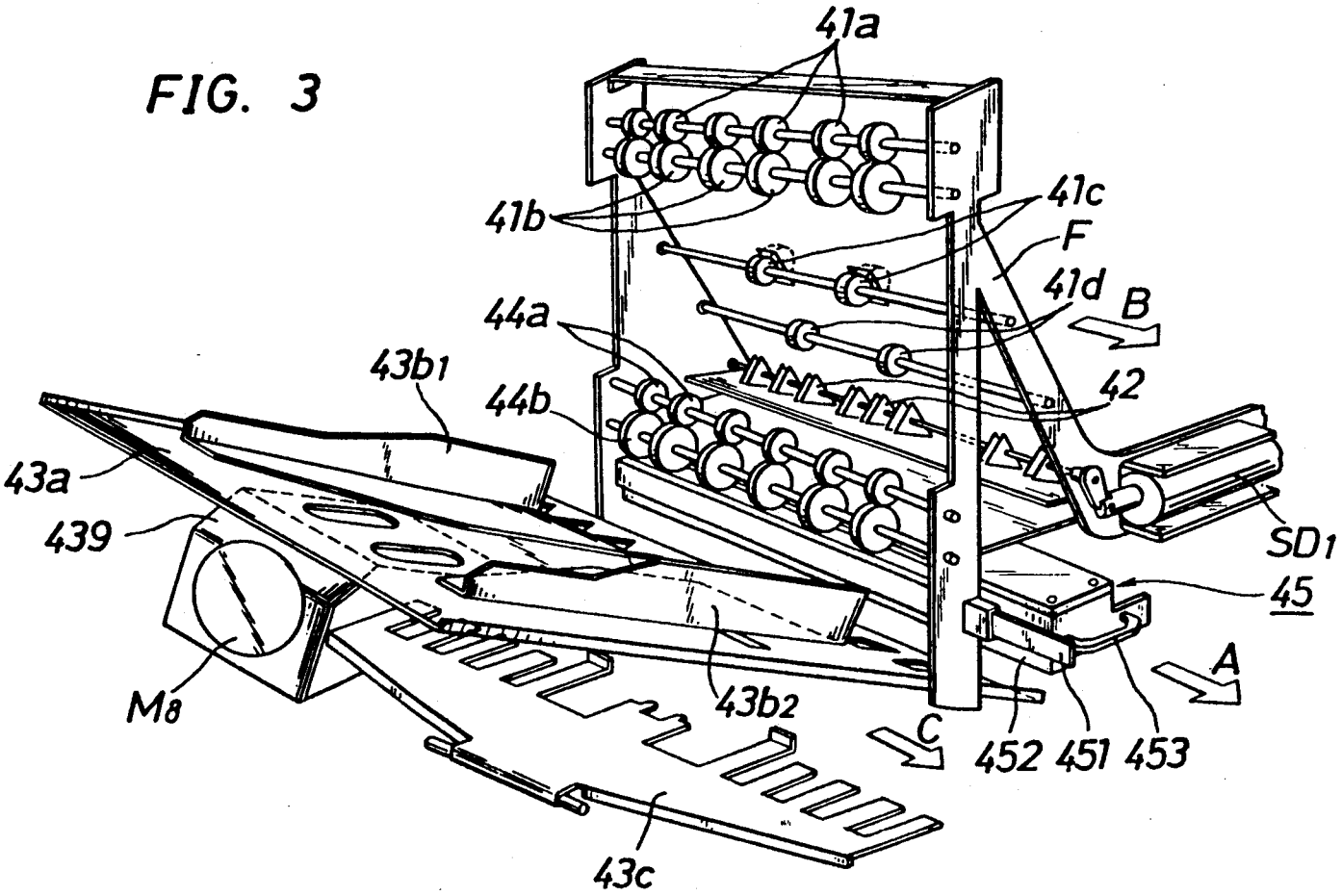
FIG. 3 is a perspective view of the main part of the recorded sheet handling apparatus according to the present invention.

FIG. 3 is a perspective view showing the main part of the copied sheet handling apparatus. Rollers 41*a*, 41*b*, 41*c*, and 41*d* constitute convey rollers 41 together with other rollers (not shown). The path switching gate 42 is driven by a solenoid $SD_1$. When the solenoid $SD_1$ is not energized, the path switching gate 42 is located at the first position where the copied sheets are conveyed to the discharge tray 40. However, when the solenoid $SD_1$ is energized, the path switching gate 42 is switched to the second position where the copied sheets are conveyed to the stacker 43. Rollers 44*a* and 44*b* constitute convey rollers 44. The rollers 41 and 44 can be pulled forward together with a frame F so as to allow easy maintenance, as indicated by arrow B. These rollers are integrally assembled in the frame F.

The stacker 43 comprises an inclined plate 43*a* a pair of side plates $43b_1$ and $43b_2$ slidably mounted on the upper surface of the inclined plate 43*a* so as to adjust the distance between the side plates $43b_1$ and $43b_2$, and a copied sheet stopper 43*c* located below the inclined plate 43*a* so as to move back and forth. The stacker 43 can be integrally pulled as a unit toward a direction of arrow C.

Figure 4:
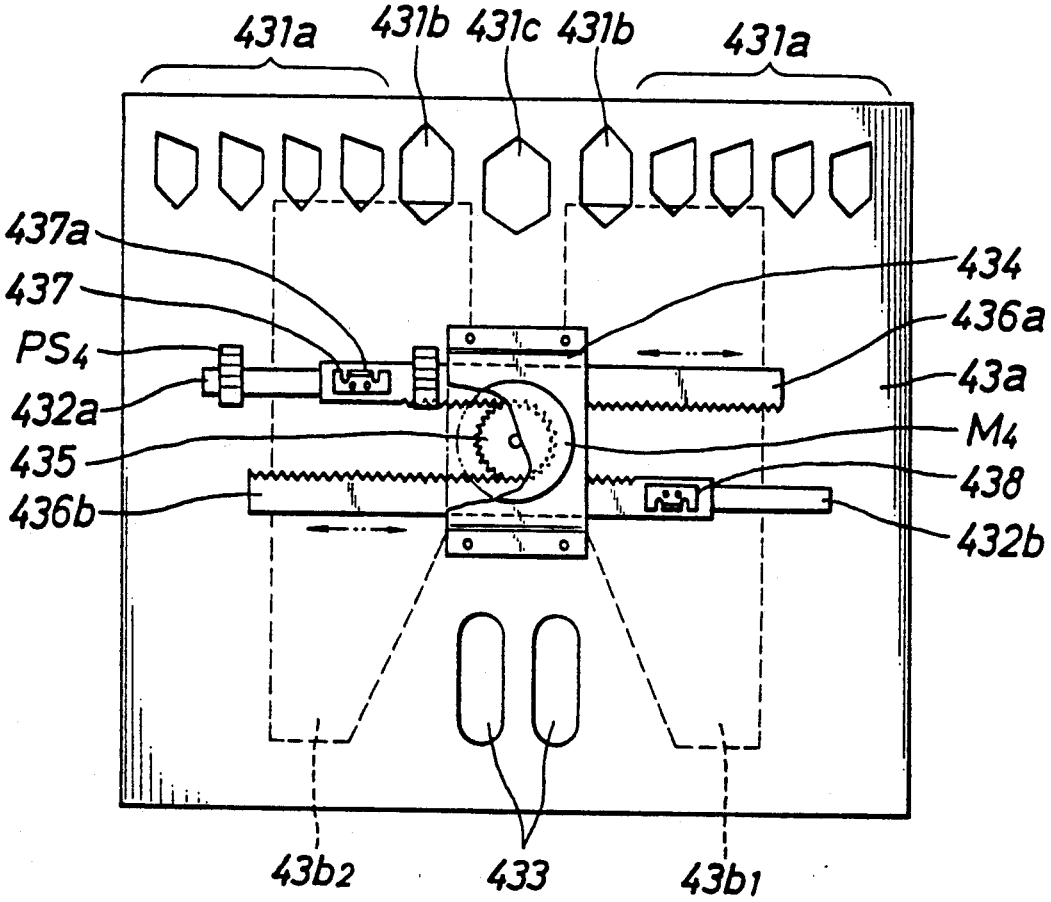
FIG. 4 is a rear view of an inclined plate of the recorded sheet handling apparatus according to the present invention.

The inclined plate 43*a* has a plurality of openings 431*a*, 431*b*, and 431*c* formed near the front end (when viewed from the rear side of the inclined plate, as shown in FIG. 4). Two elongated slots 432*a* and 432 *b* are formed at the central portion of the inclined plate 43*a* and extend along the transverse direction. Vent holes 433 are formed near the lower end of the inclined plate 43*a*.

A motor $M_4$ is mounted on the rear surface of the inclined plate 43*a* through a support plate 434. A gear 435 is fixed to the rotating shaft of the motor (side plate distance adjusting motor) $M_4$. Two slidable members 436*a* and 436*b* having toothed portions on inner sides thereof are meshed with the gear 435 and are parallel to each other. the slidable members 436*a* and 436*b* are fixed on the side plates $43b_1$ and $43b_2$ (located on the upper surface of the inclined plate 43*a*) through metal pieces 437 and 438, respectively. Elongated projections are formed on the slidable plates 436*a* and 436*b* and loosely fitted in the slots 432*a* and 432*b*, respectively. A photosensor (side plate home position sensor) $PS_4$ is arranged near the end of tee slot 432*a* to detect the reference positions (home positions) of the side plates 43*b*$_1$ and 43*b*$_2$. The photosensor $PS_4$ detects that an upright portion 437*a* of the metal piece 437 shields light, thereby detecting the home positions. With the above arrangement, when the side plate distance adjusting motor $M_4$ is rotated through a predetermined angle in the forward or reverse direction, the slidable members 436*a* and 436*b* are moved in a direction indicated by the solid or broken line by a predetermined distance. As a result, the slide plates 43*b*$_1$ and 43*b*$_2$ are separated from each other or come close to each other.

As shown in FIG. 3, a motor $M_8$ for driving a ventilation fan and a duct 439 are mounted near the vent holes 433 on the lower surface of the inclined plate 43*a*.

The stopper 43*c* will be described below.

Figure 5:
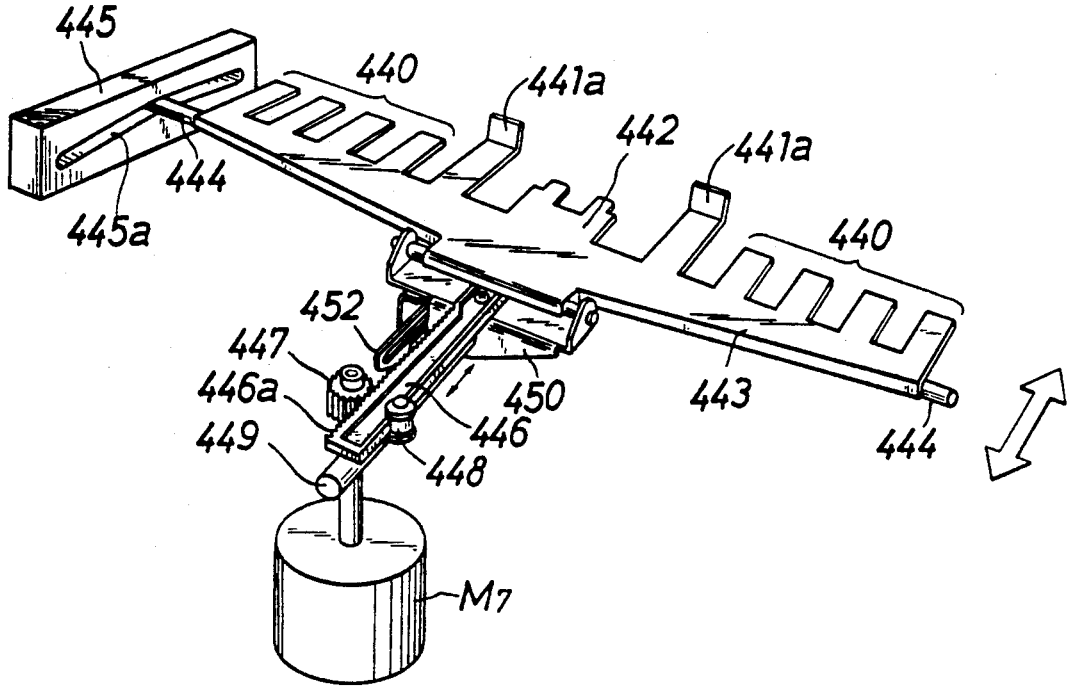
FIG. 5 is a perspective view of a stopper driving mechanism.

As shown in FIG. 5, the stopper 43*c* comprises a plate member 443 consisting of a plurality of straight projections 440 extending forward, two L-shaped projections 441 having upright portions 441*a*, and a wide central projection 442. Pins 444 extend from the right and left ends of the plate member 443. The pins 444 are engaged with grooves 445*a* formed in the side surfaces of plastic guides 445 (only the left guide is illustrated) fixed on the frame of the apparatus, respectively. A drive rod 446 extending backward is mounted at the central portion of the plate member 443. Teeth 446*a* formed on the longitudinal side of the drive rod 446 are meshed with a pinion 447. The pinion 447 is driven by a motor (stopper drive motor) $M_7$ in the forward or reverse direction so that the drive rod 446 is guided by a roller 448 and a guide rod 449 and is linearly moved in the direction of an arrow. When the rod 447 is linearly moved, the pins 444 are guided along the grooves 445*a* of the guides 445 and are reciprocally moved in the directions of a double-headed hollow arrow.

Assume that the projections 440, 441, and 442 of the plate member 443 of the stopper 43*c* are located at positions respectively corresponding to the openings 431*a*, 431*b*, and 431*c*. When the plate member 443 is moved forward, the projections 440, 441, and 442 pass through the corresponding openings 431*a* to 431*c*, and the stopper 43*c* is located above the inclined plate 43*c*. In the forward position of the plate member 443, the projections 441 extend upward from the inclined plate 43*a* through the openings 431*b*, and the upright portions 441*a* serve as stopper elements for stopping the copied sheets sliding along the inclined plate 43*a* to a predetermined position.

The handling unit 45 comprises a punching machine and two stoppers located at both sides of the punching machine. These components of the handling unit 45 are mounted in a frame 452 which can be pulled along a guide rail 451 (in a direction indicated by hollow arrow A). The main part of the handling unit 45 is illustrated in FIG. 6.

Figure 6:
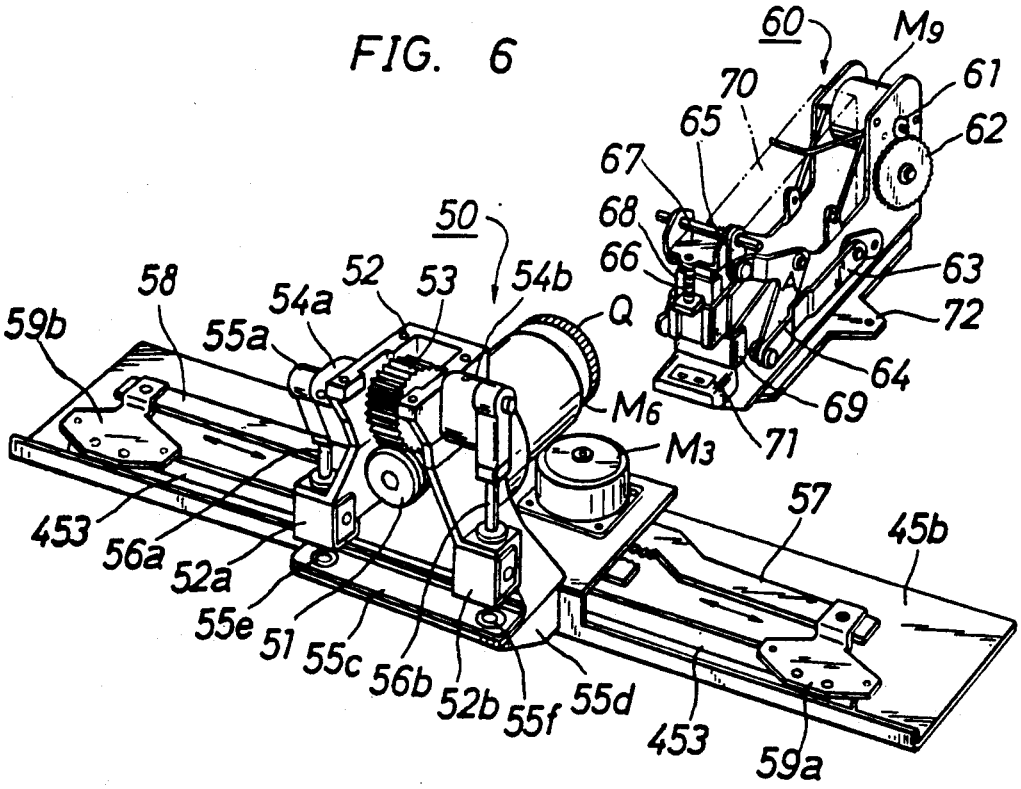
FIG. 6 is a perspective view showing a handling unit after a stapler is removed.
Figure 7A:
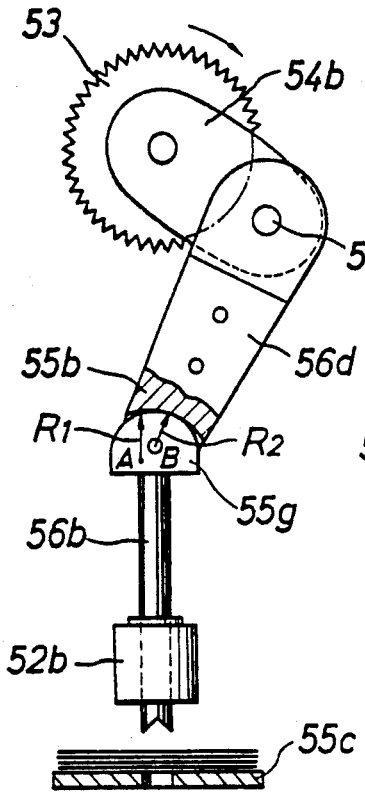
FIGS. 7(*a*) to 7(*d*) are views showing movement of a punching force transmission mechanism, in which FIG. 7(*a*) shows a state before punching, FIG. 7(*b*) shows a state during punching, FIG. 7(*c*) shows a state after punching, and FIG. 7(*d*) shows a front view of the punching force transmission mechanism.
Figure 7B:
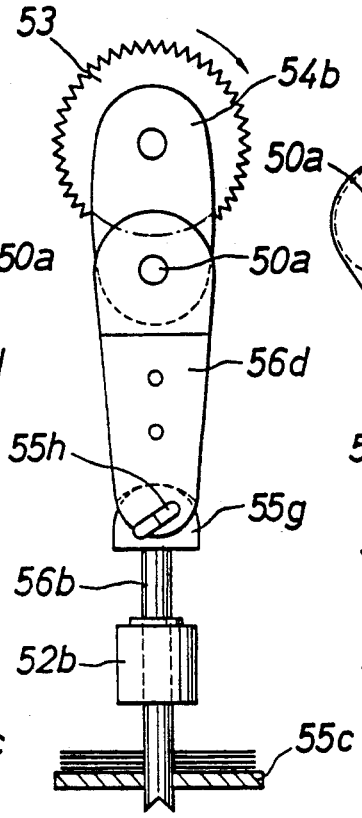
Figure 7C:
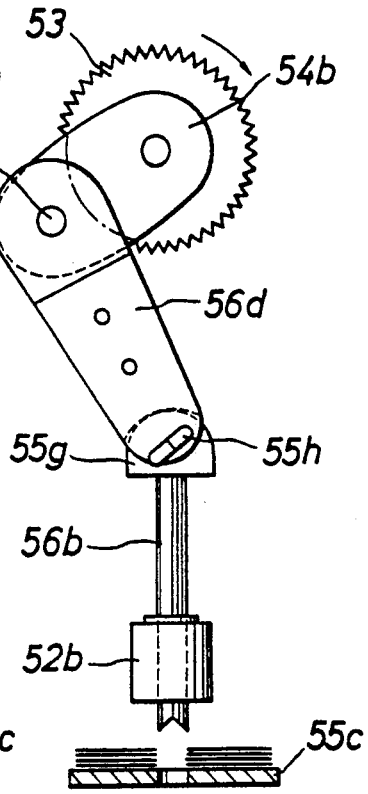
Figure 7D:
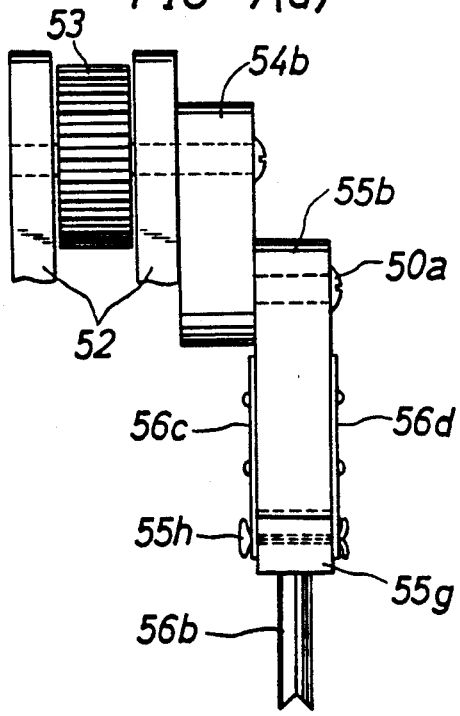

As is apparent from FIG. 6, a punching machine 50 is fixed at the central portion of a frame 45*b*, and the two staplers are movably arranged at both sides of the punching machine 50. One of the staplers is removed from the frame 45*b*, and the removed stapler is represented by reference numeral 60.

The punching machine 50 comprises a worm gear 51 which is reversibly rotatable by a motor (punch drive motor) $M_6$, a gear 53 supported by a holder 52 and meshed with the worm gear 51, two crank members 54*a* and 54*b* located at different angular positions at both sides of the gear 53, and swingable members 55*a* and 55*b* pivotally coupled to the crank members 54*a* and 54*b*. Punching pins 56*a* and 56*b* extending from the lower ends of the swingable members 55*a* and 55*b* are received by pin guides 52*a* and 52*b* integrally formed with the holder 52, respectively. Upon rotation of the motor $M_6$, the punching pins 56*a* and 56*b* are vertically moved through the worm gear 51, the gear 53, the crank members 54*a* and 54*b*, and the swingable members 55*a* and 55*b*. The punching pins 56*a* and 56*b* are inserted into or removed from dies 55*e* and 55*f* to punch sheets (a plurality of copied sheets) placed on a horizontal base 55*c*. The distal ends of the punching pins 56*a* and 56*b* are inserted in the pin guides 52*a* and 52*b* at positions slightly lower than the uppermost positions. Therefore, the punched sheet pieces can be properly removed from the pins. The punching dust is stored in a case detachably attached to the lower side of the horizontal table 55*c*. A punching dust collecting chute may be arranged below the horizontal base 55*c* and may be conveyed toward the front door of the apparatus by a conveying means such as a screw, and the conveyed dust may be stored in a storage box located inside the front door. The storage box is removed when it is filled with the punching dust. When the punching dust is removed, the storage box is attached again inside the front door. A discharge port of the punching dust is preferably of an openable type which prevents the punching dust from being dropped when the front door is open for cleaning.

The punching pin driving/supporting mechanism including the worm gear 51 and the gear 53 which cooperate to convert rotational movement of the motor $M_6$ into linear movement of the punching pins 56*a* and 56*b* is supported by the holder 52, and the dies 55*e* and 55*f* are integrally formed with the holder 52. Therefore, torsion of the frame 45*b* or the like which is caused by a pressure acting on the punching pins 56*a* and 56*b* by the recorded sheets during punching can be prevented.

A metal pulley Q is fixed on the rotating shaft of the motor $M_6$ behind the punch drive motor $M_6$. The surface of the pulley Q is roughened so as to prevent slippage when it is held by a finger. With this arrangement, when the operator pulls the handling unit, the motor $M_6$ can be manually rotated through the pulley Q. Therefore, the punching pins can be vertically moved to a desired upper position, thereby simplifying maintenance and operations for jamming.

FIGS. 7(*a*) to 7(*d*) show movement of the mechanism for transmitting the punching forces to the punching pins, in which FIG. 7(*a*) shows a state before punching, FIG. 7(*b*) shows a state during punching, FIG. 7(*c*) shows a state after punching, and FIG. 7(*d*) is a front view of the punching force transmission mechanism. The same reference numerals as in FIG. 6 denote the same parts in FIGS. 7(*a*) to 7(*d*). The lower end face of the swingable member 55*b* loosely rotatably coupled by the pin 50*a* to the crank member 54*b* rotated together with the gear 53 is constituted by an arcuated surface having an imaginary point A as its center and having a radius $R_1$.

The lower surface of the swingable member 55*b* is brought into smooth surface contact with the swingable member 55*g* made of a low-friction member (e.g., polyacetal) having a substantially arcuated surface with an imaginary surface B as its center and a radius $R_2$. As is apparent from FIG. 7(*d*), thin plates 56*c* and 56*d* are screwed on the upper and lower surfaces of the swingable member 55b. The thin plates 56c and 56d are loosely fixed by pin 55h near the imaginary point B of the slidable member 55g. The pin 55h can be a simple split pin. The radii $R_2$ and $R_2$ satisfy the following condition $R_2 \geqq R_1$.

Two slidable members 57 and 58 are parallel to each other on the frame 45 of the handling unit 45 and have opposite toothed sides. A gear (not shown) meshed with the teeth of the slidable members 57 and 58 are interposed therebetween. This gear is rotated by a motor (stapler moving motor) $M_3$ in the forward or reverse direction. Fixing plates 59a and 59b are fixed near ends of the slidable members 57 and 58 to fix the staplers When the slidable members 57 and 58 are moved in the direction of the arrow upon rotation of the motor $M_3$, the fixing plates 59a and 59b are moved accordingly along a guide rail 453 formed on the frame 45b. Therefore, the staplers 60 fixed on the fixing plates 59a and 59b are moved accordingly.

In the stapler 60, rotation of the motor (stapler drive motor) $M_9$ is transmitted to the crank member through the gears 61 and 62, and a lever 63 can be slowly and reciprocally moved. Upon reciprocal movement of the lever 63, a V-shaped lever 65 is pivoted about a pivot pin A to pivot the lever 65. When the lever 65 is moved downward, a spring 66 is compressed through a U-shaped press member 67, and a thin plate 68 is moved along a guide 69. As a result, one of the staples in a cartridge 70 is separated by the thin plate 68 and pushed outside. Therefore, the sheets (a plurality of copied sheets) placed on a table 71 are stapled.

The cartridge 70 stores a large number of linear staples. The staple arrays are stacked, and the lowermost staple array is fed to the stapling position by a belt or the like.

When the cartridge 70 is loaded in the stapler 60, the staples do not reach the stapling position. In this state, no stapling can be performed. Prior to actual stapling, a preliminary stapling mode must be set to rotate the stapler drive motor $M_9$ to feed the lowermost staple array forward in the cartridge 70. At the same time, the thin plate 68 is moved vertically several times until the test sheets are stapled. In this case, the stapler moving motor $M_3$ is operated stepwise, and the stapler 60 is moved by a predetermined distance, e.g., from the outer side to the inner side (i.e., toward the center) every preliminary stapling operation. Therefore, the test sheets are not stapled at identical positions. The staplers 60 can be mounted on the frame 45a such that mounting plates 72 at the bottom surfaces of the staplers 60 are respectively fixed to the fixing plates 59a and 59b.

The handling unit 45 comprises the single frame 45b on which the punching machine 50 is located at the center and the samplers 60 are located at both sides of the punching machine 50. The entire unit 45 can be pulled forward by a handle 453 (FIG. 3) in a direction indicated by hollow arrow A. When punching dust clogs in the case 55d or staples from the staplers 60 clog therein, the operator pulls the handle 453 to remove the handling unit 45 and can immediately remove the punching dust or staples.

Figure 8:
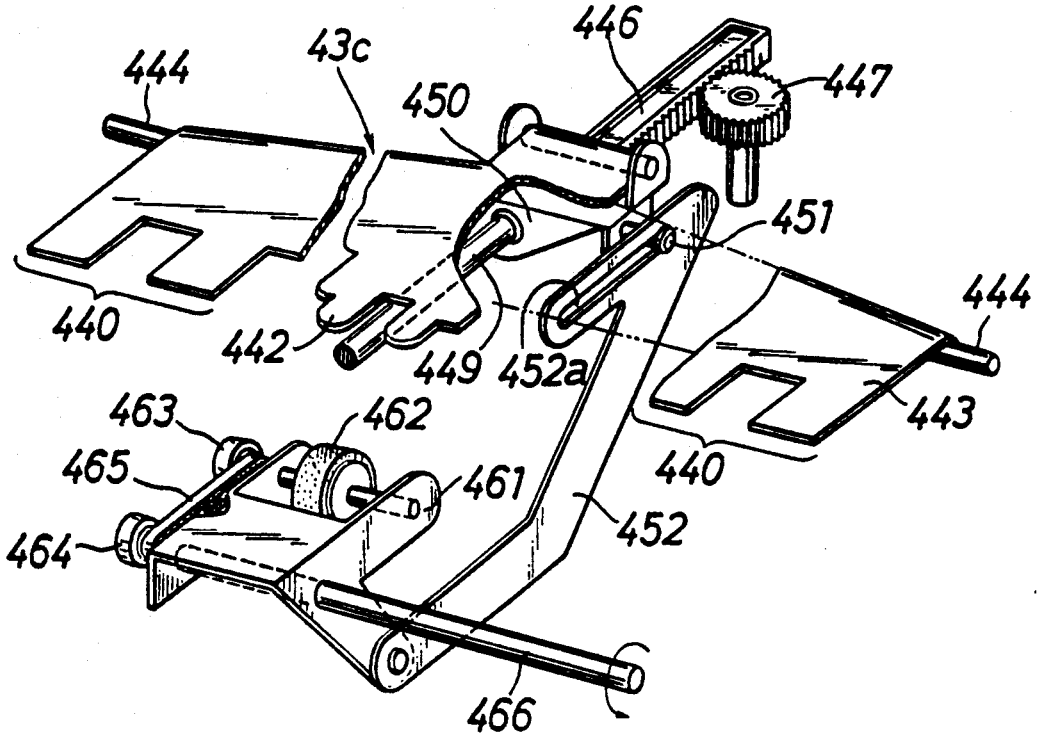
FIG. 8 is a perspective view of a discharge mechanism of handled copied sheets.

FIG. 8 shows a feed mechanism for feeding the punched or stapled sheets to the next conveying means in the stacker 43 serving as the main part of the present invention.

A U-shaped support plate 450 is mounted at the lower central portion of a plate member 443 of the stacker 43 to support a guide rod 449. A pin 451 horizontally extends from the side surface of the support plate 450. The pin 451 is engaged with a slot 452a formed at one end of a bent lever 452. One end of a V-shaped lever 461 of a roller unit 460 is loosely coupled to the other end of the bent lever 452. A feed roller 462 is rotatably mounted at the center of the roller unit 460 attached to the other end of the bent lever 452. The feed roller 462 is rotated by a shaft 466 rotated by a motor (copied sheet convey motor) $M_1$ through a belt 465 looped between two rollers 463 and 464. In the stacking mode, the stopper 43c is engaged with the openings 431a, 431b, and 431c to cause the upright portions 441a of the projections 441 to stop the copied sheets. When the sheets are to be conveyed, the stopper 43c is moved downward, and the roller 462 extends above the inclined plate 43a, thereby feeding the handled sheets.

Figure 9:
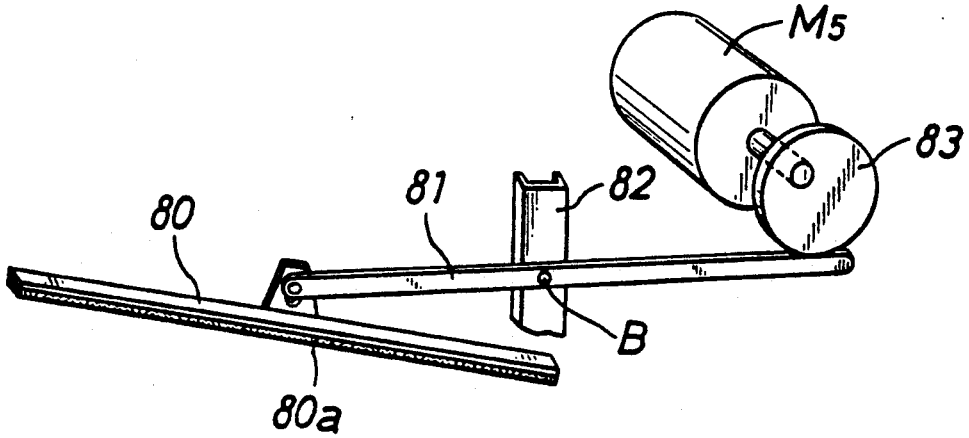
FIG. 9 is a perspective view of a mechanism for driving a paper press bar.

FIG. 9 shows a paper press bar and its driving mechanism wherein the sheet portions subjected to punching or stapling are pressed prior to punching or stapling of the sheets placed on the stacker 43.

The paper press bar 80 comprises an elongated metal rod and a sponge 80a attached to the lower surface thereof. The paper press bar 80 is slidably suspended by a bar 81 at the central elongated hole. The bar 81 is loosely fixed to a frame 82 such that the bar 81 can be swung like a seesaw about a point B. One end of the bar 81 is in contact with the surface of an eccentric cam 83 rotated by a motor (paper press bar drive motor) $M_5$.

Upon rotation of the motor $M_5$, the other end of the bar 81 is vertically moved by the eccentric cam 83. When the motor $M_5$ is rotated in synchronism with punching or stapling, the copied sheets prior to stapling can be pressed by the weight of the paper press lever 80.

FIGS. 10 show the layout of the motors, the sensors, and the solenoids which are arranged in the copied sheet handling apparatus. Some of these have already described, but the functions of all of them will be summarized below.

| | Function |
|---|---|
| Motor | |
| Copied Sheet Convey Motor $M_1$ | Convey the handled sheets from the stacker 43 and to convey them to the tray 46 |
| Copied Sheet Convey Motor $M_2$ | Convey the copied sheets from the copying machine 2 to the tray 40 or the stacker 43 |
| Stapler Moving Motor $M_3$ | Adjust positions of the staplers 60; this motor is preferably a stepping motor |
| Side Plate Distance Adjusting Motor $M_4$ | Adjust the distance between the side plates of the stacker 43 in accordance with the paper size; this motor is preferably a stepping motor |
| Paper Press Drive Motor $M_5$ | Move the paper press bar 80 vertically in synchronism with punching and/or stapling |
| Punch Drive Motor $M_6$ | Move the punching pins 56a and 56b in the punching machine 60 vertically |
| Stopper Drive Motor $M_7$ | Move the plate member 443 in the stopper 43c reciprocally |
| Stacker Fan Drive Motor $M_8$ | Drive the fan for supplying air to the upper surface of the inclined |

-continued

| | Function |
|---|---|
| | plate 43a in the stacker 43 |
| Stapler Drive Motors $M_9$, $M_{10}$ | Press staples of the staplers |
| Tray Lifting Motor $M_{11}$ | Move vertically the base 46a which supports the punched or stapled copied sheets |
| Sensor | |
| Discharge Sensor $PS_1$ | Detect that the copied sheets are delivered to the tray 40 |
| Stacker Discharge Sensor $PS_2$ | Detect that the copied sheets are delivered onto the stacker 43 |
| Stacker Empty Sensor $PS_3$ | Detect that the stacker 43 is empty |
| Side Plate Home Position Sensor $PS_4$ | Detects the home positions of the side plates $43b_1$ and $43b_2$ |
| Stopper ON Sensor $PS_5$ | Detect that the stopper 43c reaches the predetermined stopper position |
| Tray Discharge Sensor $PS_6$ | Detect that the punched and/or stapled copied sheets are discharged onto the tray 46 |
| Temporary Stop Sensors $PS_7$, $PS_8$ | Detect that the punched and/or stapled copied sheets are slid to the predetermined position on the inclined plate 43a |
| Punch Sensor $PS_9$ | Detect that the punch drive motor $M_6$ is rotated by one revolution |
| Stapler Home Position Sensor $PS_{10}$ | Detect the home positions of the staplers 60 |
| Paper Press Bar Sensor $PS_{11}$ | Detect the home position of the paper press bar drive motor $M_5$ |
| Stapler Sensors $PS_{12}$, $PS_{13}$ | Detect that each of the stapler drive motors $M_9$ and $M_{10}$ is rotated by one revolution |
| Tray Upper Limit Sensor $PS_{14}$ | Detect that the position of the base 46a of the tray 46 exceeds the predetermined upper limit |
| Tray Lower Limit Sensor $PS_{15}$ | Detect that the position of the base 46a of the tray 46 is lower than the lower limit position. |
| Stopper OFF Sensor $PS_{16}$ | Detect that the stopper 43c is moved downward to the predetermined position |
| Solenoid | |
| Solenoid $SD_1$ | Switch the path switching gate 42 |
| Solenoid $SD_2$ | Brake the base 46a of the tray 46 |

Figure 11:
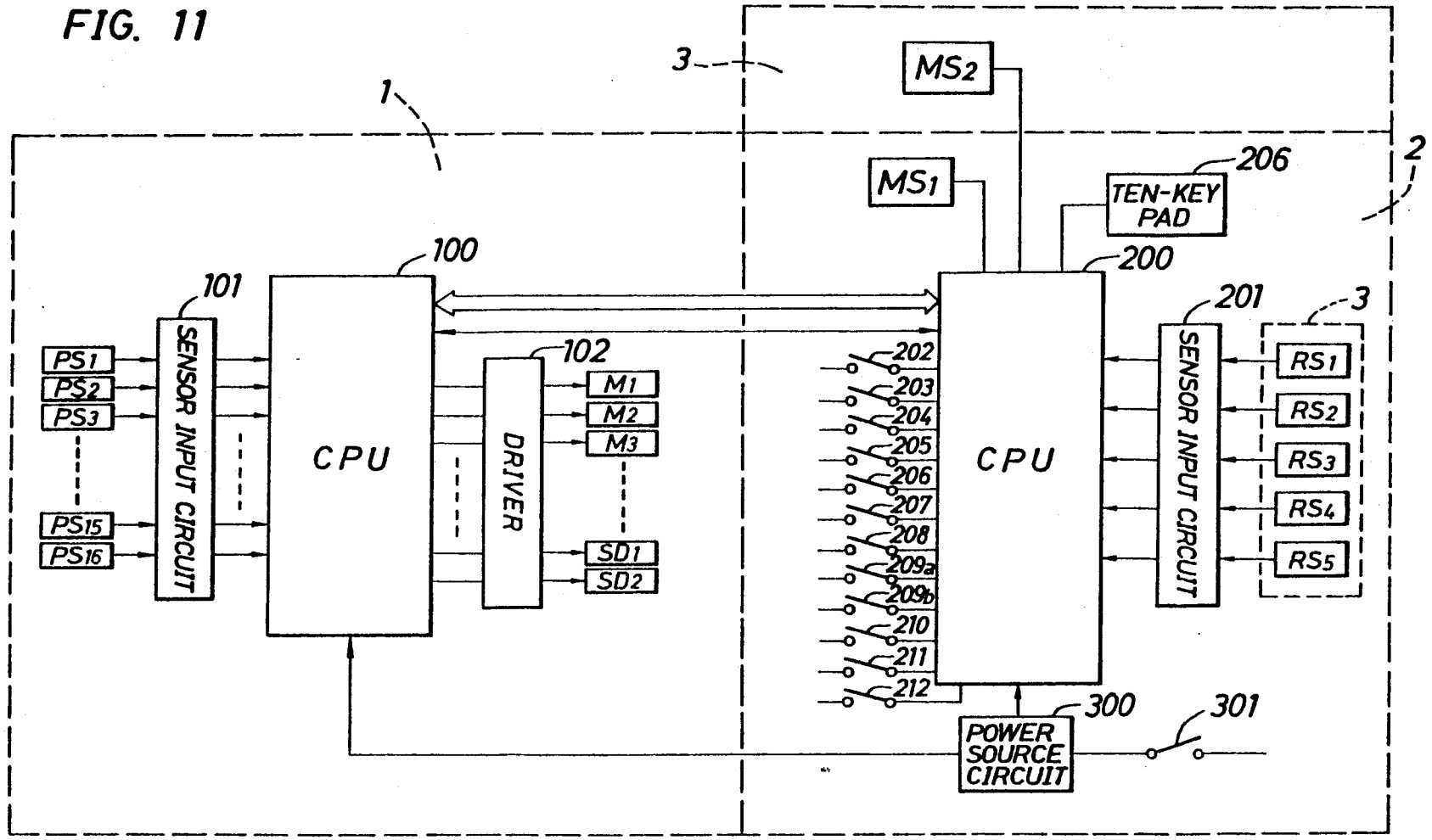
FIG. 11 is a diagram showing control circuits in the copied sheet handling apparatus and the copying machine.
Figure 13:
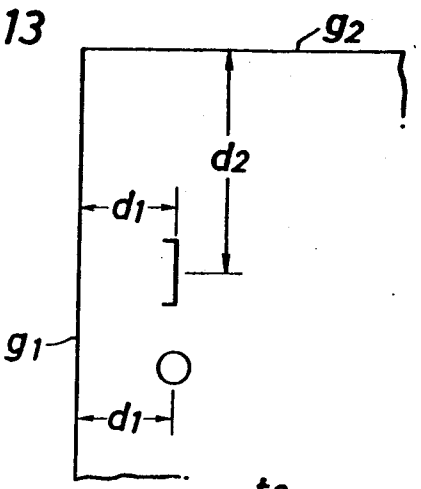
FIG. 13 is a view for explaining punching and stapling positions from the left side edge and the leading end of the copied sheet.

FIG. 11 is a block diagram of control circuits of the copies sheet handling apparatus and the copying machine.

The control circuit in the copied sheet handling apparatus 1 comprises the sensors $PS_1$ to $PS_{16}$, a sensor input circuit 101 for converting the analog signals into digital signals which can be processed by a CPU 100, and a driver 102 for driving the motors $M_1$ to $M_{11}$ and the solenoids $SD_1$ and $SD_2$. The control circuit in the copying machine 2 comprises the sensors $RS_1$ to $RS_5$ arranged in the RDF 3, an sensor input circuit 201 for converting analog sensor outputs into digital signals which can be processed by a CPU 200, a copy button 202 arranged in the form of an operation button in the operation panel in the copying machine 2, a size selection button 203 for selecting a size of a copying sheet, a mode selection button 204 for selecting a handling mode of the copied sheet handling apparatus 1, a stapling position designation button 205 for designating a stapling position, a punching designation button 206 for designating whether punching is to be performed, an automatic document size detection button 207 for automatically determining a size of a copying sheet by detecting the size of the document in the RDF 3, a ten-key pad 208 for setting the number of copies or the number of sets of copies, handling position setting mode buttons 209*a* and 209*b* for respectively setting a longitudinal distance (to be referred to as a longitudinal depth hereinafter) from the side edge of the recorded sheet to the punching or stapling position and a transverse distance (to be referred to as a transverse depth hereinafter), respectively, a manual feed selection button 210 for manually feeding the document without using the RDF 3, a handling start button 211 arranged on the operation panel in the copying machine 211, and a manual mode selection button 212 for selecting the manual document feed mode. The longitudinal depth is defined as a distance $d_1$ from one side edge $g_1$ of the copied sheet to the punching or stapling position, and the transverse depth is defined as a distance $d_2$ from the other side edge $g_2$ to the stapling position. In this embodiment, the longitudinal and transverse depths $d_1$ and $d_2$ of the punching and stapling positions can be arbitrarily determined. However, the transverse depth $d_2$ for the punching position is fixed.

Upon sequential depressions of the size selection button 203, the paper size is changed in the order of A3, B4, F4, A4, and B5. Further depressions of the button 203 allow repetitions of the above order. When the mode selection button 204 is depressed once, the stacking mode is set. When this button is depressed twice, the stapling mode is set. When the button is depressed three times, the punching-stapling mode is selected. Further depressions of this button allow the repetitions of this order. When the stapling position designation button 205 is depressed once, the stapling position is designated as a corner a of the copied sheet F. When the button 205 is depressed twice, the position is designated as a corner b. When the button 205 is depressed three times, the stapling positions are designated as both the corners a and b. The key input signals are coded by the CPU 200 in the copying machine and are output as 3-bit signals to the CPU 100 in the handling apparatus 1. When the punching designation button 206 is not depressed, "no punching" is designated. However, when the button 206 is depressed, "punching" is designated. This designation signal is coded by the CPU 200, and the corresponding code is transmitted to the CPU 100.

The manual feed button 212 is depressed to manually feed the document without using the RDF 3. The CPU 200 performs program processing according to the document size determined by a member (not shown) corresponding to the regulating plate 11*a* mounted on the manual guide plate L or a document size designated by a manual input for the first original of the document to be copied. The CPU 200 neglects subsequent detection of a change in document size upon movement of the regulating plate. When the handling start button 211 is depressed, the CPU 200 outputs a last sheet signal (to be described later). When the handling position setting mode button 209*a* or 209*b* is depressed, the longitudinal or transverse depth mode is set. Thereafter, the operator operates the ten-key pad 208 to set the punching or stapling depth. The CPU 200 then outputs a handling position signal and this signal is transmitted to the CPU 100. The copying machine 2 further includes a power source circuit 300. When a power switch 301 arranged in the operation panel is turned on, power is supplied from the power source circuit 300 to the constituting components of the copying machine 2 as well as the components of the handling apparatus 1.

The operation panel of the copying machine 2 also includes a density control means and a magnification selecting means for selecting a reduction or enlargement ratio. However, these components are not directly associated with the present invention, and a detailed description thereof will be omitted.

The circuit of the RDF 3 is not directly associated with the present invention, and a detailed description thereof will be omitted. The microswitch $MS_2$ which is turned on/off upon operation of the regulating plate 11*a* mounted on the document table 11 is connected to the CPU 200 of the copying machine 2. The ON signal from the microswitch $MS_2$ is input as a document size signal.

The operation of the copied sheet handling apparatus will be described below. The copied sheet handling apparatus of this embodiment has the following three handling modes.

(a) Stacking Mode

The document is simply copied as in the conventional copying machine without performing punching or stapling. The copied sheet is discharged on the discharge tray 40.

(b) Stapling Mode

A plurality of copied sheets are stapled with a stapler or staplers. In this mode, the stapling position can be designated by the stapling position designation button 205 as only the corner a or b, or both the corners a and b. The standard longitudinal depth $d_1$ for the stapling position is set to be 20 mm, and the transverse depth $d_2$ therefor is set to be 10 mm. However, the handling position setting mode button 209*a* or 209*b* is depressed and the operator operates the ten-key pad 208 to arbitrarily set the longitudinal or transverse depth $d_1$ or $d_2$. The selected depths $d_1$ and $d_2$ are displayed on a display unit arranged in the operation panel in the copying machine.

(c) Punching-Stapling Mode

A plurality of copied sheets are punched and stapled. In this case, only the central punching position is designated, and the corner a or b, or both the corners a and b can be designated as the stapling positions. The longitudinal depths $d_1$ for the punching and stapling positions and the transverse depth $d_2$ for the stapling position can be different from the standard values ($d_1=20$ mm and $d_2=10$ mm) as in the stapling mode (b) by selectively using the handling position setting mode buttons 209*a* and 209*b*. For example, an operation for copying a document consisting of three A4 originals to obtain two sets of copied sheets will be described below.

The power switch 301 in the copying machine 2 is turned on regardless of the operation mode of the copied sheet handling apparatus. Three originals are placed on the document table 11 of the RDF 3 in an order of the first page, the second page, and the third page from the top.

Figure 15:
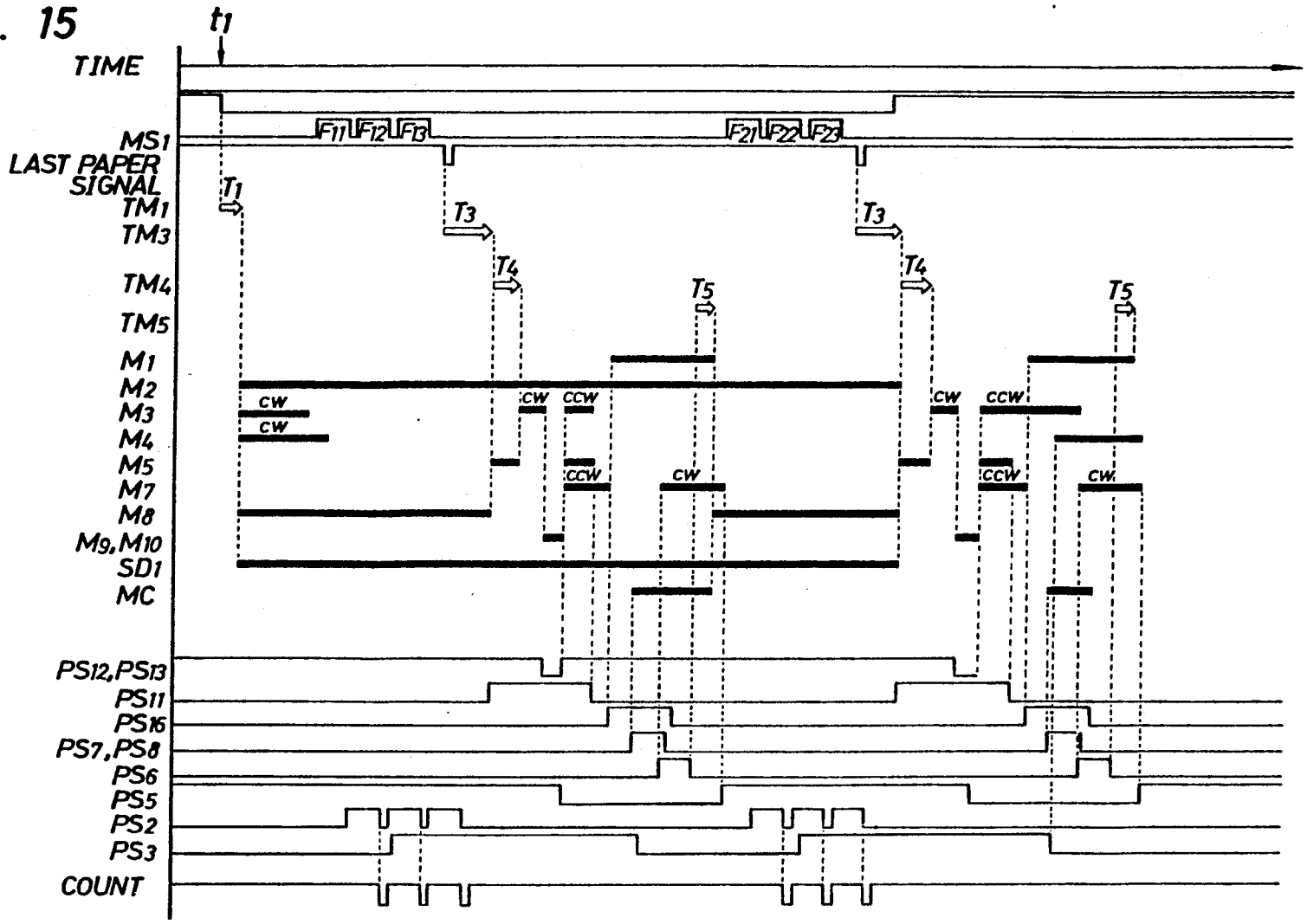
FIG. 15 is a timing chart for explaining the stapling mode according to the present invention.

When the power switch 301 is turned on, the following loads are initialized. The stapler moving motor $M_3$ is rotated by the predetermined number of pulses (e.g., 20 pulses) in the forward direction and then in the reverse direction. When the sampler home position sensor $PS_{10}$ is turned on, the motor $M_3$ is stopped. The side plate distance adjusting motor $M_4$ is rotated by the predetermined number of pulses (e.g., 20 pulses) in the forward direction and then in the reverse direction. When the side plate home position sensor $PS_4$ is turned on, the motor $M_4$ is stopped. The paper press bar drive motor $M_5$ is driven in the forward direction until the paper press bar sensor $PS_{11}$ is turned on. The punch drive motor $M_6$ is rotated in the forward direction until the punch sensor $PS_9$ is turned on. When the power switch 301 is turned on at time $t_0$, the punch drive motor $M_6$ is rotated in the forward direction after the lapse of the time interval $T_0$ required for rising the sensors and the power source, as shown in FIG. 15. When the punch drive motor $M_6$ is rotated in the forward direction, the punch sensor $PS_9$ is turned on. The punch sensor is turned off when the punching pins return to the home positions. The trailing edge of the pulse from the punch sensor $SP_9$ is detected, and the motor $M_6$ is stopped. Therefore, the punching pins 56*a* and 56*b* return to the uppermost home positions and prepare for the next punching operation. However, when the copied sheets are left on the stacker 43 upon the ON operation of the power switch 301, the punching pins need not return to the home positions. In this case, an alarm representing that the copied sheets are left in the stacker 43 is signalled to the operator.

The stopper drive motor $M_7$ is rotated in the reverse direction upon a lapse of a predetermined period of time after the paper press bar drive motor $M_5$ and the punch drive motor $M_6$ are completely initialized. The stopper drive motor $M_7$ continues to rotate until the stopper ON sensor $PS_5$ is turned on. The position corresponding to the stop of the stopper drive motor $M_7$ is the standard position. In this case, the punching or stapling position determined by the position of the stopper 43*c*, that is, the longitudinal depth $d_1$ is the standard position (e.g., 20 mm). The stapler drive motors $M_9$ and $M_{10}$ continue to rotate until the stapler sensors $PS_{12}$ and $PS_{13}$ are turned off if they are kept on. The above operations are the initialization operations.

Stacking Mode

Figure 14:
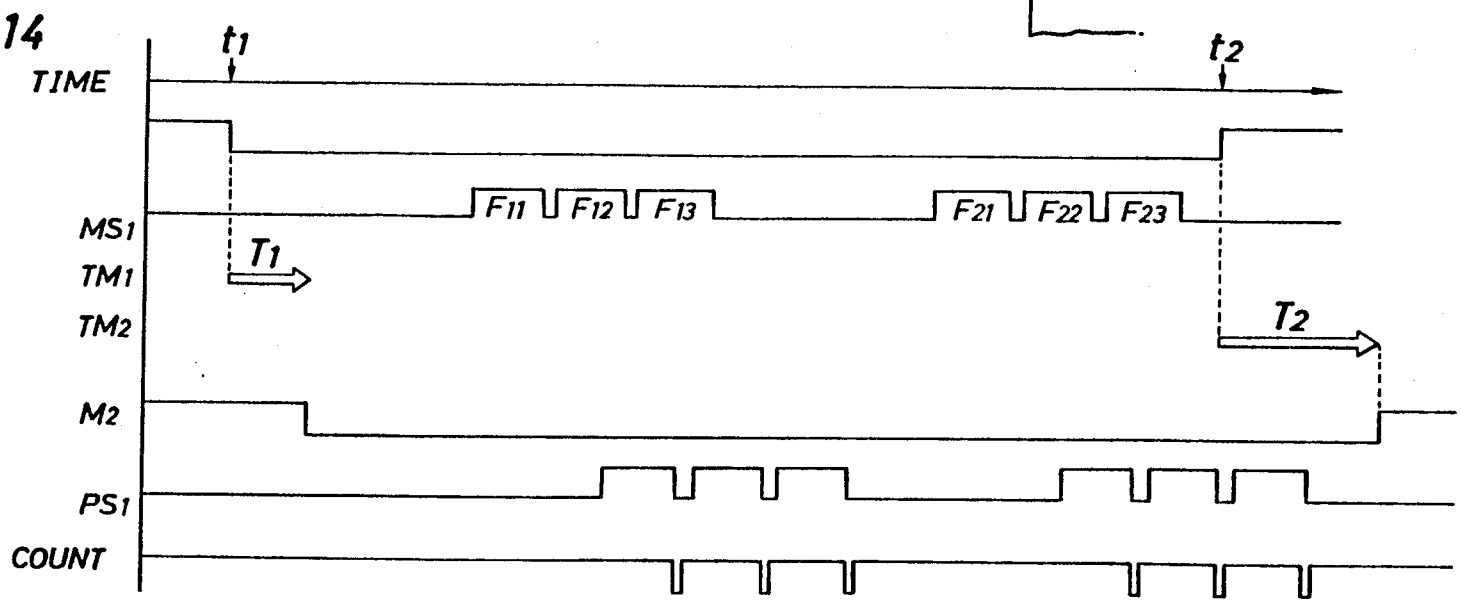
FIG. 14 is a timing chart for explaining the operation in the stacking mode according to the present invention.

FIG. 14 is a timing chart for the stacking mode.

The operator depresses the mode selection button 204 in the operation panel in the copying machine 2 once to select the stacking mode.

The operator depresses the size selection button 203 four times to select the A4 paper size.

When the operator depresses the copy button 202 at time $t_1$, the RDF 3 is operated to feed the lowermost original (the third page in this case) and the fed original is moved along the glass plate 10 of the copying machine 2, as previously described. Meanwhile, the original is illuminated by the optical system 19, and light reflected by the original is emitted on the photosensitive drum 23, thereby forming a latent image of the original image. In this manner, a series of electrophotographic operations are performed.

A transfer sheet F of the A4 size selected by the size selection button 203 is fed from the cassette 27. The visible or toner image of the original image is transferred by the transfer unit 28 to the transfer sheet P.

After the image is fixed by the fixing unit 30, the sheet is discharged by the discharge roller 31 outside the copying machine. The discharge of the sheet $F_{11}$ is detected by the discharge microswitch $MS_1$.

The ON signal from the copy button 202 is transmitted to the CPU 100 in the control circuit in the handling apparatus 1, and a start timer $TM_1$ arranged in the CPU 100 is started. After a lapse of a predetermined period of time of the start timer $TM_1$, the copied sheet convey motor $M_2$ in the handling apparatus 1 is started. As a result, the first copied sheet $F_{11}$ (the third page) discharged from the copying machine 2 is directed toward the discharge direction by the path switching gate 42. The sheet $F_{11}$ is discharged by the convey rollers 41 onto the discharge tray 40. The discharge of the sheet $F_{11}$ is detected by the discharge sensor $PS_1$, and an output from the discharge sensor $PS_1$ is temporarily input to the CPU 100 through the sensor input circuit 101 and to the CPU 200. The CPU 200 performs a count-up operation every trailing edge of the output from the discharge sensor $SP_1$.

After the first original (the third page) is fed in the RDF 3, the RDF 3 feeds the next or second original (the second page), and the copying machine 2 performs copying as in the first original. The above operation is also repeated for the third original of the document. The copied sheets are sequentially discharged from the copying machine. The sheets $F_{12}$ and $F_{13}$ discharged from the copying machine 2 are discharged onto the discharge tray 40 by the convey rollers 41 of the handling apparatus 1. Meanwhile, the CPU 200 continues the count-up operations every trailing edge of the output from the discharge sensor $PS_1$.

While the copied sheets $F_{11}$, $F_{12}$, and $F_{13}$ as a set (three pages) are discharged onto the discharge tray 40, The CPU 200 compares the count based on the trailing edges of the outputs from the discharge sensor $PS_1$ with the count based on the outputs from the recirculation discharge sensor $RS_5$ arranged in the RDF 3. If these counts coincide with each other, the originals of the document for the second set of copied sheets are fed.

The document feeding for the second set of copied sheets by the RDF 3 and the conveying and discharge of the copied sheets in the copied sheet handling apparatus 1 are the same as those of the first set of copied sheets, and a description thereof will be omitted. The second set of copied sheets are represented by reference symbols $F_{21}$, $F_{22}$, and $F_{23}$ in FIG. 14.

As is apparent from FIG. 14, when the last copied sheet $F_{23}$ (the first page) of the second set is discharged from the the copying machine 2 and the discharge thereof is detected by the discharge microswitch $MS_1$, copying is ended after a lapse of a predetermined period. When a predetermined time interval $T_2$ has elapsed after the end of copying, the copied sheet convey motor $M_2$ is stopped. This time interval $T_2$ is counted by a stop timer $TM_2$ incorporated in the CPU 100. The timer $TM_2$ is started from copying end time $t_2$.

As described above, the stack mode is ended.

Stapling Mode

FIG. 15 is a timing chart for the stapling mode.

The operator depresses the mode selection button 204 in the operation panel twice to select the stapling mode and operates the size selection button 203 to select the A4 paper size. Alternatively, the operator depresses the automatic document size detection button 207. The operator depresses the stapling position designation button 205 once to designate the stapling position as the corner a. In addition, the operator depresses the handling position setting mode button **209*a* and operates the ten-key pad 208 to designate the longitudinal depth $d_1$. The operator depresses the handling position setting mode button 209*b* and operates the ten-key pad 208 again to set the transverse depth $d_2$. As a result, the CPU 200 outputs a handling position signal and this signal is output to the CPU 100. The CPU 100 supplies a drive signal to the stopper drive motor $M_7$ through the driver 102. The drive signal designates movement of the stopper 43*c* by differences between the designated values and the standard position values. Therefore, the stopper 43*c* is moved by the differences (see operation of the motor $M_7$ after a lapse of the time interval $T_1$ after time $t_1$ in FIG. 14**).

When the operator depresses the copy button 202 at time $t_1$, the originals of the document are fed by the RDF 3 one by one, and the originals are sequentially copied by the copying machine 2. The copied sheets are then sequentially output from the copying machine 2. The discharge of the copied sheets $F_{11}$, $F_{12}$, and $F_{13}$ of the first set is detected by the discharge microswitch $MS_1$. The CPU 200 counts the number of discharged sheets on the basis of the outputs from the microswitch $MS_1$. When the count (three in this case) representing the number of copied sheets output from the copying machine 2 coincides with the count (three in this case) on the basis of the recirculation discharge sensor $RS_5$ in the RDF 3, a last paper signal is output after a lapse of a short period of time. The stapling start timer incorporated in the CPU 100 starts counting upon generation of the last paper signal.

The CPU 200 transfers two types of depth signals set with the ten-key pad 208 to the CPU 100 upon depression of the copy button 202. The CPU 100 supplies a pulse drive signal to the stopper drive motor $M_7$ through the driver 102. The pulse drive signal represents the number of pulses corresponding to the longitudinal depth $d_1$, and the stopper **43*c* is driven in accordance with this signal (see the operation of the motor $M_7$ after the lapse of $T_1$ after $t_1$ in FIG. 14). When the time interval $T_1$ set in the start timer $TM_1$ incorporated in the CPU 100 has elapsed after the copy button 202 is depressed, the convey motor $M_2$, the stapler moving motor $M_3$, the side plate distance adjusting motor $M_4$, and the stacker fan drive motor $M_8$ are rotated and at the same time the path switching solenoid $SD_1$ is energized. As a result, the convey rollers 41 are rotated and the two samplers 60 are moved from the home positions toward the direction of the punching machine 50 through the slidable members 57 and 58. The side plates 43*b*$_1$ and 43*b*$_2$ are moved from the home positions to the positions corresponding to the paper size, and the stacker fan is driven. The path switching gate 42 is directed toward the copied sheet handling direction. Each of the copied sheets is swung by the side plates 43*b*$_1$ and 43*b*$_2$** and is thus aligned in position.

The stapler moving motor $M_3$ and the side plate distance regulating motor $M_4$ are rotated after stapling in the forward direction by an amount (e.g., 20 pulses) determined by the selected paper size upon energization of the apparatus and then are rotated in the reverse direction. The stapler moving motor $M_3$ is stopped when the home position sensor $PS_{10}$ is turned on. The side plate distance regulating motor $M_4$ is stopped when the home position sensor $PS_4$ is turned on. Therefore, the staplers and the side plates are always kept at the corresponding home positions. The motors $M_3$ and $M_4$ are kept rotated in the forward direction until the home position sensors $PS_{10}$ and $PS_4$ are turned off if these sensors are kept on upon initial forward rotation of the motors $M_3$ and $M_4$.

After the lapse of the time interval $T_1$ after time $t_1$, the stapler moving motor $M_3$ causes the staplers 60 to move by a distance obtained by adding the transverse depth $d_2$ set with the ten-key pad 208 to the distance predetermined by the A4 paper size. The side plate distance regulating motor $M_4$ is rotated by an amount enough to move the side plates 43$b_1$ and 43$b_2$ to the positions substantially corresponding to the A4 paper size. In this manner, when the two staplers 60 are moved to positions substantially corresponding to the width of the selected paper prior to stapling, movement of the staplers to the stapling position (i.e., a position slightly inside the edge of the sheet) can be small. Therefore, stapling can be immediately started, and therefore the handling time can be advantageously shortened. In this above operation, the staplers 60 are kept at positions slightly outside the edge of the paper because all the copied sheets are properly set in the handling position since the opening for the handling position for punching or stapling of a plurality of copied sheets is not so wide.

Prior to actual stapling, the staplers 60 are moved to the positions near the copied sheets. The time required for moving the staplers for actual stapling to the stapling positions (i.e., positions slightly inside the A4 paper) can be shortened. Therefore, the total stapling time can be shortened. According to the test of the present inventors, it took 1.8 seconds to move the staplers 60 from the home positions to the stapling positions. However, it took only 0.6 second or less to move from the positions slightly outside the A4 paper to the stapling positions.

The copied sheets $F_{11}$, $F_{12}$, and $F_{13}$ sequentially fed to the handling apparatus 1 are directed to the handling direction by the path switching gate 42. The sheets are fed by the convey rollers 44 to the stacker 43, which is detected by the discharge sensor $PS_2$.

When a preset time interval $T_3$ of a stapling start timer $TM_3$ after generation of the last paper signal has elapsed, a paper press bar actuating timer $TM_4$ incorporated in the CPU 100 is started and the paper press bar drive motor $M_5$ is rotated. At this time, the stacker fan is stopped. After the lapse of the preset time $T_4$ of the paper press bar actuating timer $TM_4$, the paper press bar drive motor $M_5$ is stopped, and the stapler moving motor $M_3$ is rotated again, thereby moving the two staplers 60 toward the direction of the punching machine 50. The motor $M_3$ is rotated and stopped at a position where the staplers 60 are located at the initially set transverse depth $d_2$ (i.e., the 24-mm position inside the edge of the paper) within the area of the A4 paper selected by the size selection button.

When the stapler moving motor $M_3$ is stopped, the stapler drive motors $M_9$ and $M_{10}$ are rotated. Rotation of the drive motors $M_9$ and $M_{10}$ is transmitted as linear movement of the levers 63 through the gears 61 and 62. The V-shaped levers are pivoted about the pivot pins A. As a result, the levers 65 are pivoted and the press members 67 press the springs 66 and are moved downward. The thin plates 68 are moved downward along the guides 69, and each staple is separated by the corresponding thin plate 68 and is pushed outside. Therefore, the copied sheets are stapled with staples. In this case, the stapling position corresponds to the initial transverse depth $d_2$ set with the ten-key pad 208.

When the stapler drive motors $M_9$ and $M_{10}$ are stopped, the stapler moving motor $M_3$ is rotated in the reverse direction and the staplers 60 are moved to the positions slightly outside the A4 paper. Thereafter the stapler moving motor $M_3$ is stopped, and at the same time the paper press bar drive motor $M_5$ is rotated. When the paper press bar sensor $PS_{11}$ detects the home position of the drive motor $M_5$, the motor $M_5$ is stopped.

At this time, the stopper drive motor $M_7$ starts rotation in the reverse direction. As is apparent from FIG. 5, the pinion 447 is rotated and the drive rod 446 meshed therewith is retracted. As a result, the plate member 443 is guided by the right and left guides 445 and is retracted. When the plate member 443 is retracted to some extent, the projections 440 and 441 extending forward are moved downward since the grooves 445*a* are inclined. The projections 440 and 441 are moved below the openings 431*a*, 431*b*, and 431*c* of the inclined plate 43*a*. In particular, the upright portions 441*a* of the projections 441 are moved below the openings 431*b*, the copied sheets ($F_{11}$, $F_{12}$, and $F_{13}$) can be slid along the inclined plate 43*b*. When the stopper 43*c* is retracted to the predetermined position, the stopper OFF sensor $PS_{16}$ is turned on, and the stopper drive motor $M_7$ is stopped.

When the stopper OFF sensor $PS_{16}$ is turned on and at the same time the copied sheet convey motor $M_1$ is rotated, the shaft 466 shown in FIG. 8 is rotated, and the feed roller 462 is rotated through the rollers 463 and 464 and the belt 465. The stapled set of copied sheets ($F_{11}$, $F_{12}$, and $F_{13}$) placed on the inclined plate 43*a* is fed out by the feed roller 462 and is slid along the inclined plate 43*a*. When the temporary stop sensors $PS_7$ and $PS_8$ arranged along the widthwise direction of the copied sheet detect the leading edge of the copied sheets, a convey clutch MC (FIG. 10) is actuated to rotate the convey rollers 47 and 48. The copied sheets are conveyed by the convey rollers 47. Since the rollers 47 are driven at an equal speed, the sheets are not misaligned during conveyance. Since one of the convey rollers is covered with the sponge material, even if the thickness of the copied sheets is changed, the rollers 47 can clamp the sheets with a proper force. The structure of the convey rollers 48 is the same as that of the convey rollers 47. When the leading edge of the set of the copied sheet is detected by the tray discharge sensor $PS_6$, the stopper drive motor $M_7$ is rotated and the plate member 443 is moved forward by the mechanism shown in FIG. 5. The rotational angle of the stopper drive motor $M_7$ is the one required for moving the stopper 43*c* to the position corresponding to the longitudinal depth $d_1$ preset with the ten-key pad 208.

When the tray discharge sensor $PS_6$ detects the trailing edge of the set of copied sheets and is turned off, an $M_1$ OFF timer $TM_5$ incorporated in the CPU 100 is started. After a lapse of a predetermined time interval $T_5$ preset in the $M_1$ OFF timer $TM_5$, the copied sheet convey motor $M_1$ is stopped, and the stacker fan drive motor $M_8$ is started again to start ventilation.

Meanwhile, when the stopper 43 is moved forward and reaches the position corresponding to the preset longitudinal depth $d_1$, the stopper drive motor $M_7$ is stopped.

One set of copied sheets ($F_{11}$, $F_{12}$, and $F_{13}$) is placed on the base 46*a* of the storage tray 46.

While the handling apparatus 1 performs stapling of the set of copied sheets, the RDF 3 starts feeding of the document for the second set of copied sheets. The copying machine 2 repeats the same electrophotographic operations as in the first set of copied sheets.

As shown in FIG. 14, when the second set of copied sheets $F_{21}$, $F_{22}$, and $F_{23}$ are sequentially discharged from the copying machine 2 and the discharge thereof is detected by the discharge microswitch $MS_1$, a last paper signal is output. The stapler start timer $TM_3$ is started to count the preset time interval $T_3$. After the lapse of the preset time interval $T_3$, the paper press bar actuating timer $TM_4$ incorporated in the CPU 100 is started and at the same time the paper press bar drive motor $M_5$ is started. The subsequent operation sequence of the timers and the motors are the same as in the first set of copied sheets, and a description thereof will be omitted. Only the differences between the second set and the first set are the operation of the staplers 60 and the side plates 43$b_1$ and 43$b_2$. More specifically, as for the second set, the staplers 60 return to the home positions after stapling. This can be achieved such that the stapler moving motor $M_3$ is kept rotated until the home position sensor $PS_{10}$ detects the home positions of the staplers 60. The side plates 43$b_1$ and 43$b_2$ also return to the home positions. This can be similarly achieved such that the side plate distance regulating motor $M_4$ is kept rotated until the side plate home position sensor $PS_4$ detects that the side plates reach the corresponding home positions.

In the above embodiment, two sets of copied sheets are prepared. The stacker fan drive motor $M_8$ is not started when the $M_1$ OFF timer $TM_5$ counts the time interval $T_5$.

In this manner, the stapling mode is ended.

Punching-Stapling Mode

Figure 16:
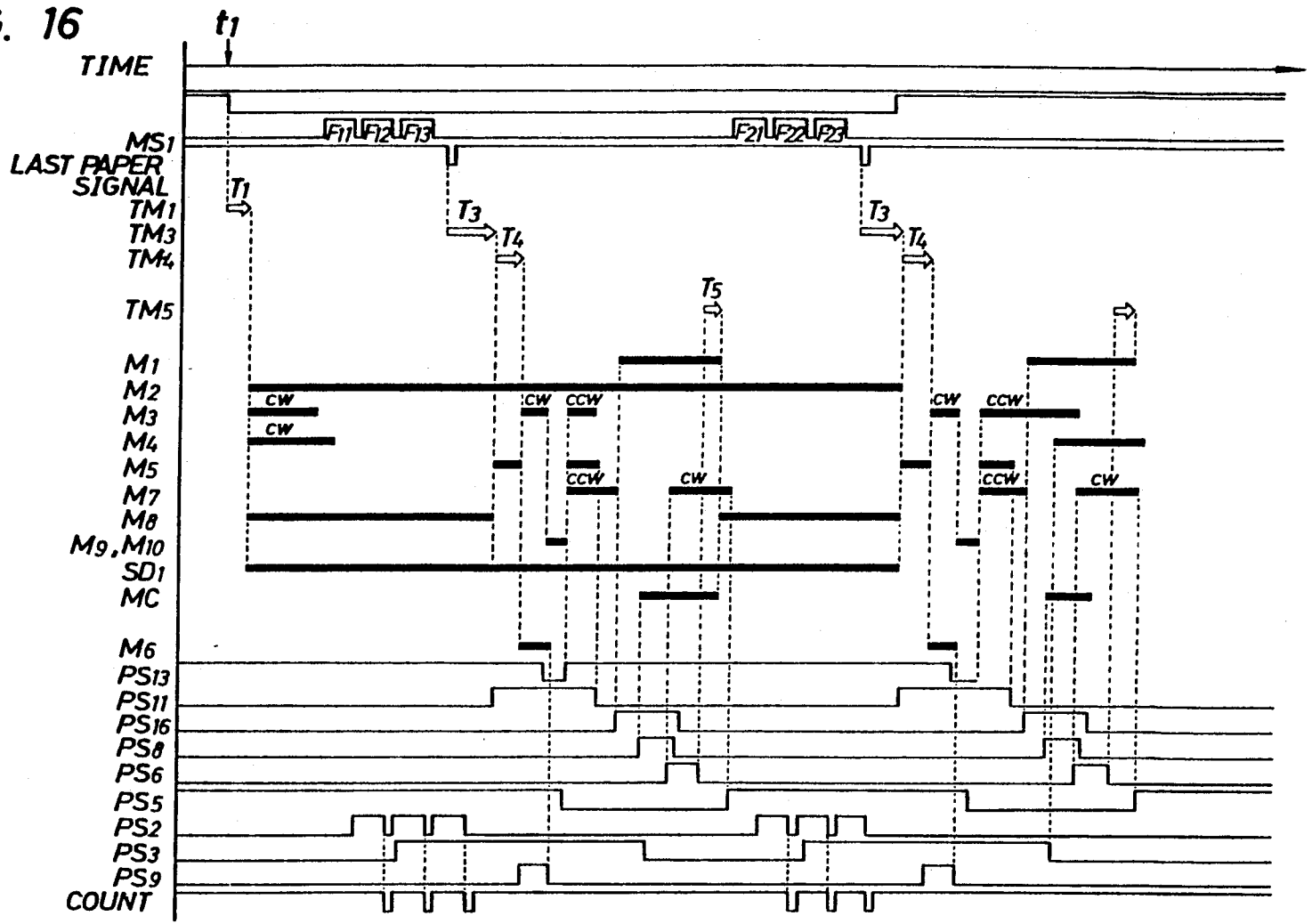
FIG. 16 is a timing chart for explaining the punching-stapling mode according to the present invention.

FIG. 16 is a timing chart in the punching-stapling mode.

The operator depresses the mode selection button 204 in the operation panel to select to the punching-stapling mode and depresses the size selection button 203 to select the A4 paper size. Alternatively, the operator may depress the automatic document size detection button 207. The operator depresses the punch designation button 206 to designate "punching". In addition, if the operator wishes to change the standard position (longitudinal depth: 20 mm; and transverse depth: 10 mm) for the punching or stapling position. For this purpose, the operator selectively depresses the handling position setting mode buttons 209*a* and 209*b* and sets the punching and stapling positions with the ten-key pad 208.

The timing chart of FIG. 16 is compared with that of FIG. 15. As is apparent from this comparison, the stapling operations in FIG. 16 are the same as those in FIG. 15, and only the punching operations are added. In other words, a sequence of the punching drive motor $M_6$ and the punch sensor $PS_9$ is added.

It should be noted that refer to the stapling operations of FIG. 15 for the stapling operations in FIG. 16, and that only the punching operations will be described below.

When the preset time interval $T_3$ of the paper press bar actuating timer incorporated in the CPU 100 has elapsed, the punch drive motor $M_6$ is started. As shown in FIG. 6, when the punch drive motor $M_6$ is rotated, the worm gear 51 in the punching machine 50 is rotated and the gear 53 meshed with the worm gear 51 is rotated. The two crank members 54*a* and 54*b* fixed to the rotating shaft of the gear 53 are rotated. In this case, since the crank members 54*a* and 54*b* are fixed at a predetermined angular interval (e.g., 50°), the punching operations of the punching pins 56*a* and 56*b* through the swingable members 55*a* and 55*b* are differentiated as a function of time. With this arrangement, the load acting on the punch drive motor $M_6$ can be reduced. According to the present inventors, the capacity of the motor $M_6$ can be reduced by several tens of %. The punching operation will be described with reference to FIGS. 7(*a*) to 7(*d*). As shown in FIG. 7(*a*), when the gear 53 is rotated in a direction of an arrow, the crank member 54*b* is rotated together with the gear 53. The swingable member 55*b* is pivoted counterclockwise about the pin 50*a*. The lower end face of the swingable member 55*b* is in smooth surface contact with the surface of the slidable member 55*g*, so that the lower end face of the swingable member 55*b* moves the arcuated surface of the slidable member 55*g* downward. Therefore, the punching pin 56*b* is moved downward, as shown in FIG. 7(*b*). The torque of the punch drive motor $M_6$ is transmitted through the gear 53, the crank member 54*b*, the swingable member 55*b*, the slidable member 55*g*, and the punching pin 56*b* to the set of copied sheets placed on the horizontal base 55*c*.

When the gear 53 is continuously rotated in the direction of the arrow, the swingable member 55*b* is slowly pivoted counterclockwise, as shown in FIG. 7(*c*). However, since the slidable member 55*g* is engaged by the pin 55*h* with the thin plates 56*c* and 56*d*, the slidable member 56*g* is moved upward and the distal end of the punching pin 56*b* is removed from the recorded sheets.

As described above, the punching force is transmitted through surface contact between the arcuated surfaces. The pin 55*b* need withstand with only a weak force upon upward movement of the punching pin. Therefore, the punching pin may have a simple structure with low rigidity, and the punching pin can be easily replaced with a new one.

When the punch drive motor $M_6$ is rotated, the worm gear 51 is rotated, and the gear 53 meshed with the worm gear 51 is rotated. The two crank members 54*a* and 54*b* fixed to the rotating shaft of the gear 53 are rotated. In this case, since the crank members 54*a* and 54*b* are fixed at a predetermined angular interval (e.g., 50°), the punching operations of the punching pins 56*a* and 56*b* through the swingable members 55*a* and 55*b* are differentiated as a function of time. With this arrangement, the load acting on the punch drive motor $M_6$ can be reduced. In the above operation, the metal pulley Q has a flywheel effect and enhances the punching capacity of the punching pins 56*a* and 56*b*. When the punch sensor $PS_9$ detects that the punch drive motor $M_6$ is rotated by one revolution and its output goes from "H" level to "L" level, the punch drive motor $M_6$ is stopped.

If the output from the punch sensor $PS_9$ does not change even after the lapse of the time interval (e.g., two seconds) for detecting one revolution of the punch drive motor $M_6$ upon a change in output from the punch sensor $PS_9$, the CPU 100 temporarily stops the motor $M_6$ because the CPU 100 determines that the punching pins 56*a* and 56*b* and hence the punch drive motor $M_6$ are overloaded or locked due to an excessive number of copied sheets or an excessive thickness of each copied sheet. The punching pins 56*a* and 56*b* return to the home positions. When the punching pins can return to the home positions, the copied sheets during handling can be easily removed.

When the punch drive motor $M_6$ is locked during punching, the operator must turn off the power switch to stop the motor $M_6$. In this case, the punch pins 56a and 56b catch the sheets F and the sheets P cannot be removed. In this case, the operator manually turns the pulley Q attached to the rear portion of the motor $M_6$ to rotate the motor $M_6$. The punch pins 56a and 56b are removed from the sheets and the sheets F can be removed.

As is apparent from the timing chart in FIG. 16, stapling is performed during punching. The first set of punched and stapled sheets $F_{11}$, $F_{12}$, and $F_{13}$ are conveyed by the convey rollers 47 and 48 onto the storage tray 46. The discharge operation after punching and stapling is the same as that in the stapling operation, and a description thereof will be omitted.

Punching and stapling of the second set are the same as those of the first set, and a description thereof will be omitted.

When punching and stapling for the second set of copied sheets $F_{21}$, $F_{22}$, and $F_{23}$ are completed as in the first set, the second set is discharged onto the storage tray 46.

In the above embodiment, no problem occurs when the two sets of copied sheets are prepared. However, when the number of sets is large, the uppermost set on the base 46a may exceed the predetermined upper limit level. When this state is detected by the tray upper limit sensor $PS_{14}$, the tray lifting motor $M_{11}$ is rotated to move the base 46a downward by one step. In this case, the solenoid $SD_2$ is actuated to brake the rotating shaft of the tray lifting motor $M_{11}$ to prevent excessive downward movement of the base 46a. When the number of sets stacked on the base 46a is increased, the above operation is repeated. When the tray lower limit sensor $PS_{15}$ detects that the base 46a reaches the lower limit position, a discharge-over signal is output. An alarm lamp is turned on or an alarm buzzer is operated on the basis of the discharge-over signal.

In this embodiment, the conventional punching machine with two punching pins, which is domestically commonly used, is illustrated. However, the number of punching pins is not limited to two but can be three or more.

In the above embodiment, a sensor may be conveniently arranged to detect the empty state of the staple cartridge, and an staple empty signal may be output. Another sensor may be conveniently arranged to alarm the full of punching dust in the case.

In the above embodiment, the storage tray for finally storing the handled copied sheets and the lifting tray are illustrated. These trays are suitable for handling a large amount of document. However, if the handling quantity is not so large, a conventional thin tray may be used.

In the above copied sheet handling operations described above, auxiliary operations during handling will be described below.

(a) Interrupt Copying

When interrupt copying is designated in the copying machine in the stapling mode or the punching-stapling mode, the copied sheet during feeding is discharged from the copying machine and the copying signal is set at "H" level. At this time, the stop timer is started. When the count of the stop timer is incremented, the timer is stopped.

(b) Front Door Open

When the front door of the copying machine is opened in the stapling mode or the punching-stapling mode, the paper press bar, stapling, and punch motors are stopped, if operated, after the current operation is completed.

In the above embodiment, the recording apparatus 2 is used together with the RDF 3. Manual copying and handling which inhibit the use of the RDF 3 due to different document sizes will be described below.

If a plurality of originals having different sizes are to be copied, the RDF shown in FIG. 3 is pivoted about the left end to the position indicated by the alternate long and short dashed line in FIG. 2. The first original of the document to be copied is placed on the exposed glass plate 10 of the copying machine 2. The RDF 3 returns to the initial position so as to hold this original. In the sense, the RDF 3 is used as a document holder.

The subsequent operations are substantially the same as these performed together with the RDF 3. The operator depresses the manual feed selection button 210 and selects the document size upon depression of the size selection button 203. The operator then depresses the mode selection button 204 to select the handling mode and depresses the stapling position designation button 205 to designate the stapling position. If the operator wishes punching, he depresses the punching designation button 206 and finally depresses the copy button 202. As a result, the first original is copied, and the copied sheet is discharged from the copying machine and is fed to the copied sheet handling apparatus 1. The operator then places the second original of the document on the glass plate 10 and the above copying operations are repeated. When all originals of the document are completely copied, the copied sheets are stacked on the stacker 43 in the handling apparatus 1. Thereafter, when the operator depresses the handling start button 211, the last paper signal is output as described in the part of "Stapling Mode". The stapling start timer incorporated in the CPU 100 is started upon generation of the last paper signal. The subsequent operations are the same as those in FIG. 15, and a description thereof will be omitted. When a series of operations are completed, a set of stapled copied sheets is discharged on the storage tray 46.

If the operator wishes to prepare several sets of stapled copied sheets, the above operations are repeated.

Figure 12:
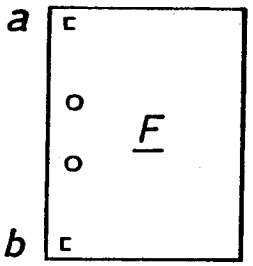
FIG. 12 is a view showing a copied sheet handling position according to the present invention.

During the series of operations described above, when the operator depresses the size selection button 203 to select a paper size different from that of the first original since the second original has a different size from that of the first original, the size selection signal is not accepted because the CPU 200 in the copying machine 2 has already received the signals from the mode selection button 204 and the manual feed selection button 210. Therefore, a change in paper size during copying is inhibited due to the following reason. If the change in paper size during copying is allowed, punching and stapling positions of the copied sheets are undesirably different from each other to result in an incomplete document. The above problem occurs since the copied sheets stacked on the stacker 43 in the copied sheet handling apparatus 1 are aligned with reference to their centers. However, if the copied sheets are stacked with reference to a corner (e.g., the corner a in FIG. 12), no stapling problems occur.

Inhibition of the change in paper size selection is canceled when designation by the mode selection button 204 or the manual feed selection button 210 is canceled.

In the above embodiment, the handling start button 211 and the manual feed selection button 210 are arranged in the copying machine 2. However, these buttons may be arranged in the recorded sheet handling apparatus 1.

Another case which inhibits the use of the RDF will be described wherein originals obtained by adhering parts of different originals are manually fed and the copied sheets are punched or stapled.

Prior to copying, the manual guide plate L of the RDF 3 is pivoted to the position indicated by the alternate long and short dashed line in FIG. 2. The operator depresses the manual mode selection button 212 to select the manual mode. Upon selection of the manual mode, the automatic document size detection function of the CPU 200 is inhibited. The operator selects the paper size with the size selection button 203. Thereafter, the operator depresses the mode selection button 204 to select the handling mode and depresses the stapling position designation button 205 to select the stapling position. If he wishes punching, he depresses the punching designation button 206.

An original G' to be copied is pushed forward along the manual guide plate L, as shown in FIG. 2. In this case, the gate 13 is located in the upward position. The distal end of the original G' is clamped by the double-feed preventive rollers 15 and is fed forward. The original G' is then fed by the feed rollers 17. The subsequent feeding and electrophotographic operations synchronized therewith in the copying machine 2 are the same as those performed together with the RDF 2, and a detailed description thereof will be omitted.

The copied sheet is discharged from the copying machine 2 and is fed to the copied sheet handling apparatus 1. The second original to be copied is manually fed along the manual guide plate L, and the above copying operations are repeated. In this case, even if the second original has a different size from that of the first original, the automatic document size detection function of the CPU 200 is kept inhibited since the manual mode selection button 212 is kept depressed. Therefore, the initially set paper size is kept unchanged. When all the originals are copied, the copied sheets are stacked on the stacker 43 in the handling apparatus 1.

When the handling start button 211 is depressed, the last paper signal is output as described in the "Stapling Mode". The stapling start timer incorporated in the CPU 100 is started upon generation of the last paper signal. The subsequent operations are the same as those described with reference to FIG. 15, and a description thereof will be omitted. When a series of operations are completed, one set of stapled sheets is discharged on the storage tray 46.

If the operator wishes several identical sets, the above operations are repeated.

Inhibition of the automatic document size detection function is canceled when designation of the manual mode selection button 212 or an equivalent is canceled.

If a single original which cannot be fed by the RDF is subjected to multiple copying, identical copied sheets must be stacked and punched or stapled.

During a series of copying operations, assume that the ten-key pad 208 is operated to set the number of copies to be 2 or more. If the manual mode is selected (by the manual mode selection button 212) and the handling mode is selected (by the mode selection button 204), the CPU 200 does not accept the data representing the number of copies. With this arrangement, two or more copied sheets are not obtained from a single original. Therefore, two or more identical copied sheets will not be fed to the stacker 43 in the copied sheet handling apparatus 1.

The double handling problem may occur when pages of a book are copied as well as copying of adhered originals of the document. However, when the book is subjected to copying, the book is open and faces down on the exposed glass plate after the RDF is lifted without performing manual document feeding. In place of the manual mode selection button, a switch may be arranged to be turned on upon lifting of the RDF.

Inhibition of the input representing the number of copies can be canceled when designation by the manual mode selection button 212 or an equivalent is canceled.

The recorded sheet handling apparatus according to the present invention is suitably used as a copied sheet handling apparatus cooperated with the copying machine. However, the recorded sheet handling apparatus according to the present invention may be combined with a recording apparatus (e.g., a printing press and a card handling apparatus) for handling a plurality of sheets having a predetermined size.

In the above embodiment, the handling apparatus for performing both punching and stapling is exemplified. The features of the present invention include applications for apparatuses for handling only punching or stapling.

What is claimed is:

1. A recorded sheet handling apparatus comprising:

an intermediate holding section for holding and stacking a set of recorded sheets, fed one by one in a feeding order, from an external source, a handling unit for selectively punching and/or stapling the recorded sheets stacked in said intermediate holding section, 'a first storage section for storing the handled recorded sheets, a first conveying means for conveying the recorded sheet from said external source to said intermediate holding section and a second conveying means for conveying the handled recorded sheets from said intermediate holding section to said first storage section, and a control means for controlling the position at which punching and/or stapling occurs in said intermediate holding section, said handling unit comprising at least one stapler movable perpendicular to a recorded sheet feed direction, a punching machine including a punching pin vertically moved by a motor, and means for manually rotating said motor detachably mounted on a rotating shaft of said motor.

2. The apparatus of claim 1, further comprising setting means for setting a handling position of the recorded sheet, a sheet stopper, a controlling means for controlling a position of a recorded sheet stopper arranged in said intermediate holding section in accordance with the holding section set by said setting means.

3. The apparatus of claim 1, further comprising setting means for setting a handling position of the recorded sheets, a sheet stopper, first control means for controlling a position of the sheet stopper arranged in said intermediate holding section in accordance with the handling position set by said setting means in a recorded sheet feed direction, and second control means for controlling a position from an edge of the recorded sheet in said handling unit in accordance with the handling position which is perpendicular to the recorded sheet feed direction and set by said setting means.

4. The apparatus of claim 1, wherein the position of a recorded sheet stopper arranged in said intermediate holding section is selectively variable.

5. The apparatus of claim 1, further comprising a stapler arranged in said handling section being movable from a home position to a first position relative to a size of the recorded sheet and a second position where the stapler operates to staple a set of recorded sheets.

6. The apparatus of claim 3, wherein a stapler arranged in said handling section is temporarily moved to a first position and is then moved to a second position to staple a set of the recorded sheets.

7. The apparatus of claim 1, wherein said intermediate holding section further comprises means for feeding a set of the handled recorded sheets to said second conveying means in synchronism with an end of handling.

8. The apparatus of claim 1, further comprising a second storage section and a third conveying means for conveying the recorded sheets without performing handling of said handling unit to said second storage section.

9. The apparatus of claim 1, wherein said intermediate holding section comprises holding means for holding the recorded sheet and a stopper which is moved to inhibit forward movement of the recorded sheets during punching or stapling and which is moved to allow the forward movement of the recorded sheets after handling.

10. The apparatus of claim 7, wherein said holding section comprises an inclined plate for holding the recorded sheets and a stopper which is moved upward above said inclined plate near an end of a lower side of said inclined plate to inhibit forward movement of the recorded sheets during punching or stapling and is moved downward below said inclined plate to allow the forward movement of the recorded sheets after handling.

11. The apparatus of claim 1, wherein said second conveying means comprises a pair of rollers rotated in opposite directions at an equal speed, at least one of said pair of rollers being adapted to absorb a change in sheet thickness.

12. The apparatus of claim 1, wherein said handling unit is arranged to be pulled out of said apparatus.

13. The apparatus of claim 1, further comprising a punching pin returning to a home position when a power switch of said apparatus is turned on.

14. The apparatus of claim 1, further comprising a punching machine in said handling unit, said punching machine comprising a plurality of punching pins, a plurality of dies respectively corresponding to said plurality of punching pins, a drive mechanism for reciprocally moving said punching pins, and a frame for supporting said punching pins, said dies, and said drive mechanism.

15. The apparatus of claim 1, further comprising punching dust collecting means arranged below a punching machine, conveying means for conveying the punching dust collected by said punching dust collecting means to a predetermined position away from said punching machine, and a storage box for storing the punching dust conveyed by said conveying means.

16. In a copying apparatus comprising a document feeder which allows manual document feeding, means for changing the size of recording sheets, and the recorded sheet handling apparatus of claim 1, the improvement comprising inhibiting means for preventing changing of the size of the recording sheets.

17. A copying apparatus comprising a document feeder which allows manual document feeding, the recorded sheeting handling apparatus of claim 1, and recording number setting means, setting means setting a recording number of one during manual document feeding.

18. The apparatus of claim 16, further comprising means for detecting a size of a document wherein said inhibiting means inhibits a change of the size of said recording sheets in accordance with a signal of a detecting means.

19. A recorded sheet handling apparatus comprising:

an intermediate holding section for holding and stacking a set of recorded sheets, fed one by one in a feeding order, from an external source, a handling unit for selectively punching and/or stapling the recorded sheets stacked in said intermediate holding section, a first storage section for storing the handled recorded sheets, a first conveying means for conveying the recorded sheets from said external source to said intermediate holding section and a second conveying means for conveying the handled recorded sheets from said intermediate holding section to said first storage section, and a control means for controlling the position at which punching and/or stapling occurs in said intermediate holding section, said handling unit comprising at least one stapler movable perpendicular to a recorded sheet feed direction, and a punching machine, said punching machine comprising a plurality of punching pins, a plurality of dies corresponding to said punching pins, and a mechanism for driving said punching pins, one of said punching pins being driven in a phase offset from those of the remaining punching pins, wherein said punching pins are vertically moved by a motor, a means for manually rotating said motor being detachably mounted on a rotating shaft of said motor.

20. A punching machine comprising:

(A) a plurality of punching pins;

(B) a punch drive means for driving said punching pins in a desired direction, said punch drive means including (a) a motor means for rotating a shaft, (b) a worm gear driven by said rotating shaft, (c) a driven gear driven by said worm gear, (d) a plurality of crank members fixed to said driven gear, and (e) a plurality of swingable members having a first end and a second end, each of said swingable members being pivotably coupled at said first end to each of said crank member, each of said swingable members being connected to a corresponding punching pin at said second end, at least one of said swingable members being driven at a different phase by said crank member;

(C) a plurality of pin guides for receiving and guiding said punching pins in said desired direction; and (D) a plurality of dies corresponding to said plurality of punching pins.

21. The punching machine of claim 20 further comprising a plurality of slidable members, each having an arcuated surface, wherein said swingable members have an arcuated surface at said second end, said arcuated surface of said swingable members being in contact with said arcuated surface of said slidable members, to move said slidable members downward, whereby said punching pins are moved downward.

22. The punching machine of claim 21 further comprising a plurality of pins and a plurality of plates, wherein said swingable members are connected to said punching pins through said pins and plates at said second end, to move said slidable members upward, whereby said punching pins are removed from said image recorded sheets.

23. The punching machine of claim 20 further comprising a detecting means for detecting one revolution of said shaft, wherein said motor means is stopped so that said punching pins return to predetermined positions.

24. The punching machine of claim 20 wherein said motor means and said worm gear are provided between said punching pins.

25. The punching machine of claim 20 wherein the rotating shaft is provided perpendicular to said punching pins.

26. The punching machine of claim 24 wherein the rotating shaft is provided perpendicular to said punching pins.

* * * * *